US006118421A

United States Patent [19]

Kawaguchi et al.

[11] Patent Number: 6,118,421

[45] **Date of Patent: *Sep. 12, 2000**

[54] METHOD AND CIRCUIT FOR DRIVING LIQUID CRYSTAL PANEL

[75] Inventors: Takafumi Kawaguchi, Yamatotakada; Toshihiro Yanagi; Makoto Takeda, both of Nara; Hisao Okada, Ikoma-gun, all of Japan

[73] Assignee: Sharp Kabushiki Kaisha, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/721,717

[22] Filed: Sep. 27, 1996

[30] Foreign Application Priority Data

Sep. 29, 1995 [JP] Japan ..... 7-254045
Nov. 16, 1995 [JP] Japan ..... 7-298753

[51] Int. Cl.[7] ..... G09G 3/36
[52] U.S. Cl. ..... 345/89; 345/96
[58] Field of Search ..... 345/89, 96

[56] References Cited

U.S. PATENT DOCUMENTS

| | | | |
|---|---|---|---|
| 5,402,142 | 3/1995 | Okada et al. . | |
| 5,565,883 | 10/1996 | Shimizu | 345/96 |
| 5,621,426 | 4/1997 | Okada et al. | 345/89 |
| 5,648,793 | 7/1997 | Chen | 345/96 |
| 5,654,733 | 8/1997 | Chimura et al. | 345/96 |

FOREIGN PATENT DOCUMENTS

| | | |
|---|---|---|
| 0 181 598 | 5/1986 | European Pat. Off. . |
| 0 241 562 | 10/1987 | European Pat. Off. . |
| 0 323 260 | 7/1989 | European Pat. Off. . |
| 0 755 044 | 1/1997 | European Pat. Off. . |
| 63-48077 | 9/1988 | Japan . |
| 2-7444 | 2/1990 | Japan . |
| 5-53534 | 3/1993 | Japan . |
| 5-181433 | 7/1993 | Japan . |

OTHER PUBLICATIONS

Ito et al, "21.3: 10.4.–in.–Diagonal Color TFT–LCDs without Residual Images", SID 90 Digest, pp. 4–8–411, 1990.

Okada et al, "An 8.4–in. Color TFT–LCD and the Driving Technologies", Technical Report of IEICE, pp. 27–33, 1993.

*Primary Examiner*—Jeffery Brier
*Attorney, Agent, or Firm*—Nixon & Vanderhye P.C.

[57] ABSTRACT

A method for driving a liquid crystal panel including a plurality of pixel electrodes arranged in a matrix, a plurality of data lines respectively connected to the pixel electrodes in a plurality of columns, a plurality of gate lines respectively connected to the pixel electrodes in a plurality of rows, and a plurality of switching devices, respectively connected to the pixel electrodes, for connecting and disconnecting the corresponding pixel electrode and the corresponding data line based on a signal sent from the corresponding gate line. The method includes the step of applying a driving voltage having a waveform corresponding to image data used for display to each data line while inverting the driving voltage gate line by gate line and frame by frame, so as to maintain an average value of the driving voltage in each frame within a certain range.

19 Claims, 16 Drawing Sheets

*PRIOR ART*

PRIOR ART

PRIOR ART

PRIOR ART

PRIOR ART

PRIOR ART

METHOD AND CIRCUIT FOR DRIVING LIQUID CRYSTAL PANEL

BACKGROUND OF THE INVENTION

1. Field of the Invention

The present invention relates to a method and a circuit for driving a liquid crystal panel, and in particular to a method and a circuit for driving an active matrix liquid crystal panel.

2. Description of the Related Art

A conventional digital driver for driving a liquid crystal panel will be described.

FIG. 1A is a block diagram showing a part of a conventional 3-bit digital driver corresponding to one output. Such a part corresponds to each of a plurality of data lines provided in a liquid crystal panel and will be referred to as a "driving unit", which is represented by reference numeral 102*a* in FIG. 1A. The 3-bit digital driver includes the number of driving units corresponding to the number of data lines provided in the liquid crystal panel.

As shown in FIG. 1A, the driving unit 102*a* includes a sampling memory (MSMP) 10 for sampling 3-bit digital image data at the rise of a sampling pulse TSMP, and a holding memory (MH) 20 for holding the digital image data sampled by the sampling memory 10 at the rise of an output pulse LS which is in phase of a horizontal synchronization (Hsyn) signal. The driving unit 102*a* further includes an output circuit (OPC) 30 for converting the digital image data held by the holding memory 20 into a voltage corresponding to the value of the digital image data and outputting the resultant voltage. The output circuit 30 receives eight types of gray scale voltages V0 through V7 from an external device.

The driving unit 102*a* operates in the following manner.

Digital image data is sampled by the sampling memory 10 at the rise of a sampling pulse TSMP, and is then held by the holding memory 20 at the rise of an output pulse LS. The digital image data held by the holding memory 20 is converted into a voltage corresponding to the value of the digital image data and is output by the output circuit 30. In other words, the output circuit 30 selects one of the gray scale voltages V0 through V7 corresponding to the value of the digital image data and outputs the selected voltage to a data line DLn corresponding to the driving unit 102*a*. The output pulse LS is output after the sampling of digital image data is finished in the driving units corresponding to all the data lines provided in the liquid crystal panel.

FIG. 1B is a circuit diagram of the output circuit 30. As shown in FIG. 1B, the output circuit 30 includes a decoder (DEC) 31 for converting the 3-bit digital image data into eight switching control signals S0 through S7, and a switch group 32 including eight analog switches ASW0 through ASW7 respectively for receiving the eight switching control signals from the decoder 31 and outputting the corresponding gray scale voltages V0 through V7 to the data line DLn.

The output circuit 30 operates in the following manner.

When a switching control signal corresponding to the value of the digital image data held by the holding memory 20 turns on an analog switch corresponding to the switching control signal, the gray scale voltage received by the analog switch is output from the output circuit 30.

When the value of the data is "4", for example, only the switching control signal S4 is activated among the eight switching control signals in the decoder 31. The switching control signal S4 turns ON the analog switch ASW4. Accordingly, the gray scale voltage V4 received by the analog switch ASW4 is output to the data line DLn.

FIG. 2 is a timing diagram illustrating the waveforms of AC signals used for driving a liquid crystal panel by the driving unit 102*a*. Specifically, FIG. 2 shows the waveforms of the gray scale signals, the Hsyn signal, a polarization (POL) signal, and a latch strobe (LS) signal. The LS signal includes a series of pulses which are output in phase with the Hsyn signal. In phase with the LS signal, the digital image data sampled by the sampling memory 10 is held by the holding memory 20 and output to the output circuit 30. The polarity (POL) signal indicates whether the voltage to be applied to the pixel electrode should be higher or lower than the voltage Vcom of the common electrode by the unit of a time period. The voltage to be applied to the common electrode will be referred to as "common electrode voltage Vcom". The time period in which the voltage to be applied to the pixel electrode should be higher (positive) with respect to the common electrode voltage Vcom is referred to as a "positive driving period", and the time period in which the voltage to be applied to the pixel electrode should be lower (negative) with respect to the common electrode voltage Vcom is referred to as a "negative driving period". The common electrode voltage Vcom is inverted with a center voltage Vcent as the center in phase with the POL signal.

In FIG. 2, only the gray scale voltages V0, V3, V4 and V7 are shown, the other gray scale voltages V1, V2, V5 and V6 being omitted for simplicity. The gray scale voltage V0 corresponds to gray scale data 0 and has the largest difference from the common electrode voltage Vcom. The gray scale voltage V7 corresponds to gray scale data 7 and has the smallest difference from the common electrode voltage Vcom. The gray scale voltages V3 and V4 are median between the gray scale voltages V0 and V7. Symbols v0, v3, v4 and v7 represent potentials of the gray scale voltages V0, V3, V4 and V7 in the positive driving period, and −v0, −v3, −v4 and −v7 represent potentials of the gray scale voltages V0, V3, V4 and V7 in the negative driving period.

The waveforms shown in FIG. 2 are used in a line inversion driving method, by which the polarity of the voltage to be applied changes line by line (gate line by gate line). The waveform of each gray scale voltage is determined so that the polarity of the voltage changes frame by frame (i.e., vertical period by vertical period). In other words, the waveforms of the gray scale voltages are inverted in phase of both the Hsyn signal and the vertical horizontal (Vsyn) signal.

This can be appreciated from FIG. 3, which shows the waveforms of the gray scale V0 in two frames together with the Vsyn and Hsyn signal. The polarity of the gray scale signal V0 is inverted horizontal period by horizontal period, and the polarities in a first frame are opposite to those in the next frame.

By the conventional driving method, as shown in FIG. 2, the output timing of the LS signal and the inverting point of the POL signal are substantially the same. This is inevitable because output of data starts by the output pulse LS. Due to such a manner of operation, the ratio of the time period in which a desired voltage is output from the driver with respect to the positive and negative driving period can be maximized.

FIG. 4 is a timing diagram illustrating waveforms for writing image data "0" and "4" to one data line together with the Vsyn signal and the Hsyn signal. Waveform W0 represents the voltage for writing image data "0" to pixels connected to one data line, and waveform W04 represents the voltage for alternately writing image data "0" and "4" to pixels connected to one data line.

Chain line Va represents an average voltage of the waveform W0 in one frame. When only display data "0" is written, the average voltage Va is equal in each two adjacent frames.

When image data "0" and "4" are alternately written, the average voltage of the waveform W04 has an average voltage Va1 in a first frame and another average voltage Va2 in a second frame which follows the first frame. As shown in FIG. 4, the average voltage Va1 is different from the average voltage Va by ΔVa(+) in the positive direction, and the average voltage Va2 is different from the average voltage Va by ΔVa(−) in the negative direction. As can be seen from these waveforms, when different display data, for example V0 and V4, are written in pixels connected to one data line, the average voltage of the waveform changes frame by frame between a value higher than the average voltage Va of waveform W0 by a certain level and another value lower than the average voltage Va by the same level.

FIG. 5A is an equivalent circuit diagram generally used in a liquid crystal panel. Such an equivalent circuit diagram is disclosed in, for example, Y. Kanamori et al., "10.4-inch. Diagonal Color TFT-LCDs without Residual Images SID'90", pp. 408–411 (1990). A pixel capacitance CLc is determined by a pixel electrode, a common electrode and a dielectric liquid crystal material interposed between the pixel electrode and the common electrode. The potential difference between the pixel electrode and the common electrode is applied to the liquid crystal material. A floating capacitance Cgd is generated by the gate electrode and the drain electrode of the TFT used as a switching device. A storage capacitor Cs can be formed in various structures. In this example, the storage capacitor Cs is formed between the pixel electrode and a gate line which is previous to the gate line to which the pixel electrode is connected.

When a liquid crystal panel is driven by the equivalent circuit shown in FIG. 5A while AC-driving the common electrode, it is preferable to minimize the change in charge level in the pixel capacitance CLc in order to obtain an image having a satisfactory quality. This is because the voltage applied to the liquid crystal material held between the pixel electrode and the common electrode is determined by the level of charge in the pixel capacitance CLc.

One method proposed to minimize the change is a floating gate method, by which the off-state voltage from the gate driver has the same waveform as that of the voltage applied to the common electrode except for the DC component. The floating gate method is disclosed in, for example, Okada et al., "8.4-inch. Color TFT Liquid Crystal Display and its Driving Technology", Technical Report of the Institute of Electronics, Information and Communication Engineers, Vol. 92, No. 467, pp. 27–33 (1993).

In the display apparatus described in the above-mentioned publication, the gate driver outputs voltages to the gate line which are DC voltages with respect to the common electrode voltage. Since the capacitances in FIG. 5B vary significantly in accordance with the structure of the TFT, satisfactory display can be obtained in different ways when certain types of display mediums are used. Even if the display quality is deteriorated by the floating method to a certain extent, a problem may not occur depending on the use of the display apparatus, or alternatively, other methods can be used for the same purpose. The floating method is one solution for driving the liquid crystal panel using the equivalent circuit shown in FIG. 5A, but is not the only solution. This is described in the above publication.

In the equivalent circuit shown in FIG. 5A, elements which may influence the display quality, namely, elements which may change the charge in the pixel capacitance CLc on the side of the TFT, are potentials of the electrodes opposed to the pixel electrodes with capacitances CLc, Cs, and Cgd interposed therebetween. That is, the elements which may influence the display quality are the common electrode and the gate lines. As can be appreciated from this, the potential of the data line is conventionally considered not to influence the display quality.

Accordingly, in the case of an ideal off-period of the TFT, even when the average potential of the data line changes frame by frame as shown in FIG. 4, such a change does not influence the display quality.

As described above, it is conventionally considered that the potential of the data line does not influence the potential of the pixel electrode after the TFT is turned off. In other words, the off-state resistance of the TFT is considered to be infinite and the capacitances are considered to be zero. This is an ideal state, which is not realized in TFTs used today, and accordingly the off-state resistance and the capacitances do influence the potential of the pixel electrode. The degree of influence varies in accordance with, for example, the material and structure of the TFT. When the degree of influence is excessive, the driving timing and driving waveforms which are determined based on the equivalent circuit shown in FIG. 5A needs to be corrected.

FIG. 5B is an equivalent circuit of the pixel including the off-state resistance Roff and the source-drain capacitance Csd of the TFT. As appreciated from FIG. 5B, the potential of the data line influences the charge of the pixel capacitance CLc on the side of the TFT through the off-state resistance Roff and the source-drain capacitance Csd. The minimum level of the off-state resistance Roff and the source-drain capacitance Csd which deteriorates the display quality depends on various elements. The reason is the intolerable degree of deterioration depends on the liquid crystal material, the number of gray scales which can be displayed, the image pattern, and also the use of the display apparatus.

With reference to FIGS. 6A and 6B, the problem of the conventional driving method caused by the source-drain capacitance Csd of the TFT will be described.

FIG. 6A shows a screen displaying an image pattern conspicuously showing the above-described problems. The image pattern has areas A through E. Central area E has an entirely uniform luminance corresponding to image data "4". In areas A through D, a checkered pattern appears by the different levels of luminance in correspondence with the image data "0" and "4" as shown in FIG. 6B.

When such a checkered pattern appears, the luminance of areas C and D sandwiching central area E change entirely. This occurs because the different average potentials of the data line inside and outside area E influence the potential of the pixel electrodes to different degrees.

FIG. 7 is a timing diagram showing the average potential of one data line, the charging potentials of pixels X and Y connected to the data line in areas C, E and D for two frames. Pixel X is in area C, and pixel Y is in area D. Pixel X is influenced by the potential of the data line in the frame in which pixel X is charged, but pixel Y is influenced by the potential of the data line in the frame following the frame in which the pixel Y is charged. Thus, the direction of change of potentials of pixel X is opposite to that for pixel Y. In this manner, the luminance of areas C and D sandwiching area E entirely change.

SUMMARY OF THE INVENTION

In this specification, a period in which data corresponding to the n'th gate line is output from a data driver is referred to as an "output period". A period in which the n'th gate line is "ON" is referred to as a "driving period". A time period in which the voltage to be applied to the pixel electrode is higher (positive) with respect to the common electrode voltage Vcom is referred to as a "positive driving period", and a time period in which the voltage to be applied to the pixel electrode is lower (negative) with respect to the common electrode voltage Vcom is referred to as a "negative driving period".

According to one aspect of the invention, a method is provided for driving a liquid crystal panel including a plurality of pixel electrodes arranged in a matrix, a plurality of data lines respectively connected to the pixel electrodes in a plurality of columns, and a plurality of gate lines respectively connected to the pixel electrodes in a plurality of rows. Also included in the liquid crystal panel are a plurality of switching devices, respectively connected to the pixel electrodes, for connecting and disconnecting the corresponding pixel electrode and the corresponding data line based on a signal sent from the corresponding gate line. The method comprising the step of applying a driving voltage having a waveform corresponding tr image data used for display to each data line while inverting the driving voltage gate line by gate line and frame by frame, so as to maintain an average value of the driving voltage in each frame within a certain range.

According to another aspect of the invention, a method is provided for driving a liquid crystal panel including a plurality of pixel electrodes arranged in a matrix, a plurality of data lines respectively connected to the pixel electrodes in a plurality of columns, and a plurality of gate lines respectively connected to the pixel electrodes in a plurality of rows. Also included in the liquid crystal panel are a plurality of switching devices, respectively connected to the pixel electrodes, for connecting and disconnecting the corresponding pixel electrode and the corresponding data line based on a signal sent from the corresponding gate line. The method comprising the step of applying a driving voltage having a waveform corresponding to image data used for display to each data line while inverting the driving voltage gate line by gate line and frame by frame, so as to maintain an average value of the driving voltage within a certain range in each of a plurality of output periods.

In one embodiment of the invention, a first pixel electrode and a second pixel electrode among the plurality of pixel electrodes are connected to an identical data line. A certain range is set so that (1) a difference of the potential of the first pixel electrode from a prescribed potential caused by a change in the average potential of the data line in a first frame in which the first pixel electrode is charged and (2) a difference of the potential of the second pixel electrode from the prescribed potential caused by the change in the average potential of the data line in a second frame following the first frame in which the second pixel electrode is charged, has a relationship which causes no substantial influence on the luminance on the liquid crystal panel.

According to still another aspect of the invention, a method is provided for driving a liquid crystal panel including a plurality of pixel electrodes arranged in a matrix, a common electrode opposed to the plurality of pixel electrodes with a liquid crystal layer interposed therebetween, a plurality of data lines respectively connected to the pixel electrodes in a plurality of columns, and a plurality of gate lines respectively connected to the pixel electrodes in a plurality of rows. Also included in the liquid crystal panel are a plurality of switching devices, respectively connected to the pixel electrodes, for connecting and disconnecting the corresponding pixel electrode and the corresponding data line based on a signal sent from the corresponding gate line. The method includes the step of applying a gray scale voltage having a waveform corresponding to image data used for display to each data line and applying a common electrode voltage to the common electrode while inverting the polarity of the gray scale voltage and the polarity of the common electrode voltage gate line by gate line and frame by frame. Both a positive gray scale voltage and a negative gray scale voltage are output in each of a plurality of output periods.

In one embodiment of the invention, the plurality of output periods includes one of a positive driving period in which a polarity of the gray scale voltage with respect to the common electrode voltage is positive or a negative driving period in which a polarity of the gray scale voltage with respect to the common electrode voltage is negative.

In one embodiment of the invention, the plurality of output periods includes both a positive driving period in which a polarity of the gray scale voltage with respect to the common electrode voltage is positive and a negative driving period in which a polarity of the gray scale voltage with respect to the common electrode voltage is negative.

In one embodiment of the invention, a time period in which the positive gray scale voltage is output and a time period in which the negative gray scale voltage is output are substantially equal, and the polarity of the gray scale voltage is inverted once in each output period.

In one embodiment of the invention, where the positive driving period and the negative driving period are each divided into a first half and a second half, the gray scale voltage is positive in the first half of the positive driving period and is negative in the first half of the negative driving period, and a voltage to be applied to each of the gate electrodes changes from a high level to a low level in phase with the polarity inverting timing of the gray scale voltage in each driving period so as to turn off the corresponding switching device.

In one embodiment of the invention, where the positive driving period and the negative driving period are each divided into a first half and a second half, the gray scale voltage is positive in the second half of the positive driving period and is negative in the second half of the negative driving period, and a voltage to be applied to each of the gate electrodes changes from a high level to a low level in phase with the end of each output period so as to turn off the corresponding switching device.

According to yet another aspect of the invention, a circuit for driving a liquid crystal panel while inverting a driving voltage gate line by gate line and frame by frame including a plurality of pixel electrodes arranged in a matrix; a plurality of data lines respectively connected to the pixel electrodes in a plurality of columns; a plurality of gate lines respectively connected to the pixel electrodes in a plurality of rows; and a plurality of switching devices, respectively connected to the pixel electrodes, for connecting and disconnecting the corresponding pixel electrode and the corresponding data line based on a signal sent from the corresponding gate line is provided. The circuit includes a plurality of digital data driving circuits, respectively provided for the plurality of data lines, for receiving a plurality of gray scale voltages having a rectangular wave and inverting output period by output period and outputting at least one gray scale voltage corresponding to the image data used for display to the corresponding data line as the driving voltage. The digital data driving circuits each output the gray scale voltage so as to generate a phase difference between the polarity inverting timing thereof and the timing of output pulses which define the output periods, and the phase difference is set so as to maintain an average value of the driving voltage applied to each data line in each frame within a certain range regardless of the potentials of the gray scale voltages corresponding to the image data used for display.

In one embodiment of the invention, the phase difference between the polarity inverting timing of the driving voltage and the timing of the output pulses is a prescribed range around 180 degrees.

In one embodiment of the invention, the polarity inverting timing of the driving voltage is delayed with respect to the timing of the output pulses.

In one embodiment of the invention, the polarity inverting timing of the driving voltage is advanced with respect to the timing of the output pulses.

In one embodiment of the invention, the circuit further includes a gate driver for sending pulses to the plurality of gate lines for turning on and off the plurality of switching devices, the gate driver sending the pulses fall in phase with the end of each output period.

In one embodiment of the invention, the circuit further includes a gate driver for sending pulses to the plurality of gate lines for turning on and off the plurality of switching devices, the gate driver sending the pulses so that the pulses fall in phase with the polarity inverting timing of the driving voltage.

In one embodiment of the invention, the circuit further includes a common electrode opposed to the plurality of pixel electrodes with a liquid crystal layer interposed therebetween; and a common electrode driver for applying a common electrode voltage having a rectangular wave and inverting output period by output period to the common electrode. The digital data driving circuit has a configuration for delaying the gray scale voltage corresponding to the image data used for display with respect to the output pulses by the phase difference, and the common electrode driver applies the common electrode voltage so that the polarity inverting timing of the common electrode voltage is substantially in phase with the timing of the output pulses which define the output periods.

In one embodiment of the invention, the circuit further includes a common electrode opposed to the plurality of pixel electrodes with a liquid crystal layer interposed therebetween; and a common electrode driver for applying a common electrode voltage having a rectangular wave and inverting output period by output period to the common electrode. The digital data driving circuit has a configuration for delaying the gray scale voltage corresponding to the image data used for display with respect to the output pulses by the phase difference, and the common electrode driver applies the common electrode voltage so that the polarity inverting timing of the common electrode voltage is delayed with respect to the timing of the output pulses which define the output periods by substantially the same degree as the gray scale voltage.

In one embodiment of the invention, the circuit further includes a common electrode opposed to the plurality of pixel electrodes with a liquid crystal layer interposed therebetween; and a common electrode driver for applying a common electrode voltage having a rectangular wave and inverting output period by output period to the common electrode. The digital data driving circuit has a configuration for advancing the polarity inverting timing of the gray scale voltage corresponding to the image data used for display with respect to the output pulses by the phase difference, and the common electrode driver applies the common electrode voltage so that the polarity inverting timing of the common electrode voltage is advanced with respect to the timing of the output pulses which define the output periods by substantially the same degree as the gray scale voltage.

In one embodiment of the invention, the circuit further includes a common electrode opposed to the plurality of pixel electrodes with a liquid crystal layer interposed therebetween; and a common electrode driver for applying a common electrode voltage having a rectangular wave and inverting output period by output period to the common electrode. The digital data driving circuit has a configuration for advancing the polarity inverting timing of the gray scale voltage corresponding to the image data used for display with respect to the output pulses by the phase difference, and the common electrode driver applies the common electrode voltage so that the polarity inverting timing of the common electrode voltage is substantially in phase with the timing of the output pulses which define the output periods.

According to the present invention, the voltage corresponding to the image data used for display is applied to the data line so as to maintain the average value of the voltage in each of the frames within a certain range regardless of the image pattern to be displayed. Due to such a driving method, deterioration in image quality caused by the off-state resistance and the source-drain capacitance of the TFT is restricted, thus improving the image quality.

In the case where the voltage is applied so as to maintain the average value of the voltage in each of the output periods within a certain range regardless of the image pattern to be displayed, the image quality is further improved.

The voltage can be applied so that the difference of the potential of a first pixel electrode caused by the change in the average potential of the data line in a frame, and the difference of the potential of a second pixel electrode caused by the change in the average potential of the data line in the next frame, have a relationship which does not influence the luminance of the image on the liquid crystal panel. In such a case, the deterioration in image quality caused by the off-state resistance and the source-drain capacitance of the TFT is restricted, thus improving the image quality.

In the case where a positive voltage and a negative voltage are output in each output period, the range of the voltage in each output period is less, thus improving the image quality.

In the case where the time period in which the positive voltage is output and the time period in which the negative voltage is output are of the same length, and further, the polarity of the voltage is inverted only once in each output period, the range of the voltage in each output period is less. Thus, the pixel electrode can be charged with a desired voltage for a longer period of time.

The liquid crystal panel can be driven in such a manner that the voltage is positive in the first half of the positive driving period and is negative in the first half of the negative driving period, and that a voltage to be applied to each of the gate electrodes changes from a high level to a low level in phase with the inverting timing of the driving voltage in each driving period so as to turn off the corresponding switching device. In such a case, the range of the voltage in each output period is less, and moreover the pixel electrode can be pre-charged in the first half of each driving period.

Alternatively, the liquid crystal panel can be driven in such a manner that the voltage is positive in the second half of the positive driving period and is negative in the second half of the negative driving period, and that a voltage to be applied to each of the gate electrodes changes from a high level to a low level in phase with the end of each output period so as to turn off the corresponding switching device. In such a case, the range of the voltage in each output period is less, and moreover each driving period can be almost entirely used for charging the pixel electrode.

Moreover, according to the present invention, a phase difference is generated between the inverting timing of the driving voltage and the timing of the output pulses. The phase difference is set so as to maintain an average value of the driving voltage applied to each data line in each frame within a certain range regardless of the potentials of the gray scale voltages corresponding to the image data used for display. Due to such a driving circuit, deterioration in image quality caused by the off-state resistance and the source-drain capacitance of the TFT is restricted, thus improving the image quality.

In the case where the phase difference is set to be a certain range of around 180 degrees, the charging time of the pixel electrode and the range of the potential of the data line can be adjusted to be optimum for the characteristics of the liquid crystal panel.

In the case where the polarity inverting timing of the driving voltage is delayed with respect to the timing of the output pulses, the average potential of the data line can be within a certain range regardless of the image pattern to be displayed.

When the polarity inverting timing of the driving voltage is advanced with respect to the timing of the output pulses, the polarity inverting timing of the common electrode voltage is also advanced with the timing of the output pulses. Thus, the range of the potential of the data line in each output period is less, and each pixel electrode is prevented from being charged with voltages having opposite polarities in one output period. Accordingly, such a manner of driving is more preferable.

In the case where the pulses from a gate driver fail to turn off the switching device in phase with the end of each output period, each pixel electrode is prevented from being charged with a driving voltage corresponding to the next pixel electrode.

In the case where the pulses from the gate driver fail to turn off the switching device in phase with the polarity inverting timing of the driving voltage, each pixel electrode is prevented from being charged with a driving voltage having a polarity opposite to the desired polarity.

The polarity inverting timing of the driving voltage can be delayed with respect to the timing of the output pulses. The common electrode voltage can be in phase with the timing of the output pulses. In such a case, the pixel electrode is charged with a potential different from the desired potential in the first half of the driving period corresponding to the delay, but is charged with the desired potential in the second half of the driving period.

The polarity inverting timing of the common electrode voltage can also be delayed with respect to the timing of the output pulses by the same phase difference as the polarity inverting timing of the driving voltage. In this case, the pixel electrode is charged with a polarity of the same polarity as that of the desired potential in the first half of the driving period corresponding to the delay, and then is charged with the desired potential in the second half of the driving period. The voltage applied in the first half of each driving period can be utilized to a certain extent for obtaining the desired voltage without being completely wasted. Such a manner of voltage application is advantageous for certain types of display mediums.

The polarity inverting timing of the driving voltage can be advanced with respect to the timing of the output pulses. The common electrode voltage can be also advanced with respect to the timing of the output pulses by the same phase difference as the polarity inverting timing of the driving voltage. In this case, the pixel electrode is charged with a polarity of the same polarity as that of the desired potential in the first half of the driving period corresponding to the advance, and then is charged with the desired potential in the second half of the driving period. The voltage applied in the first half of each driving period can be utilized to a certain extent for obtaining the desired voltage without being completely wasted. Such a manner of voltage application is advantageous for certain types of display mediums.

The polarity inverting timing of the common electrode voltage can be in phase with the timing of the output pulses. In such a case, the pixel electrode is charged with a potential different from the desired potential in the first half of the driving period corresponding to the delay, but is charged with the desired potential in the second half of the driving period.

Thus, the invention described herein makes possible the advantages of providing a method for driving a liquid crystal panel for maintaining the average potential of each of data lines within a certain range to avoid deterioration in the image quality caused by the change in the potential of the data line through the off-state resistance and the source-drain capacitance of the TFT, and a circuit for driving the liquid crystal panel using such a method.

These and other advantages of the present invention will become apparent to those skilled in the art upon reading and understanding the following detailed description with reference to the accompanying figures.

DESCRIPTION OF THE PREFERRED EMBODIMENTS

EXAMPLE 1

Figure 8A:
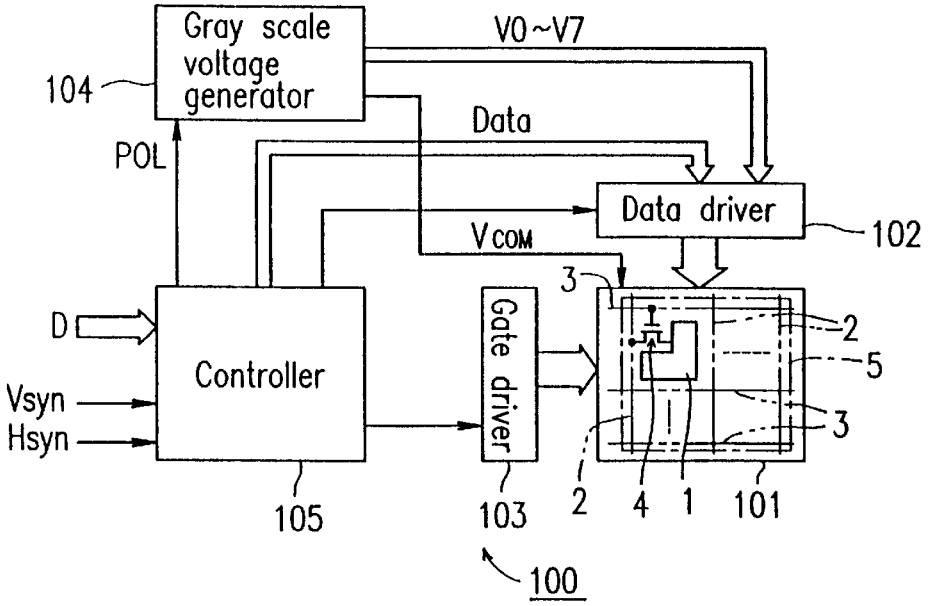
FIG. 8A is a block diagram of an LCD including a driving circuit in a first example according to the present invention.

FIG. 8A is a block diagram of an LCD 100 including a driving circuit in a first example according to the present invention.

As shown in FIG. 8A, the LCD 100 includes a liquid crystal panel 101 for displaying images using a liquid crystal material. The liquid crystal panel 101 includes a plurality of pixel electrodes 1 (only one is shown in FIG. 8A) arranged in a matrix, a common electrode 5 opposed to the pixel electrodes 1 with a liquid crystal layer (not shown) interposed therebetween, a plurality of data lines 2 each connected to the pixel electrodes 1 in the corresponding column, a plurality of gate lines 3 each connected to the pixel electrodes 1 in the corresponding row, and a plurality of switching devices 4 (for example, TFTs; only one is shown in FIG. 8A) respectively connected to the pixel electrodes 1. The switching devices 4 are each provided for connecting and disconnecting the corresponding pixel electrode 1 and the corresponding data line 2 based on a signal sent from the corresponding gate line 3.

Figure 1A:
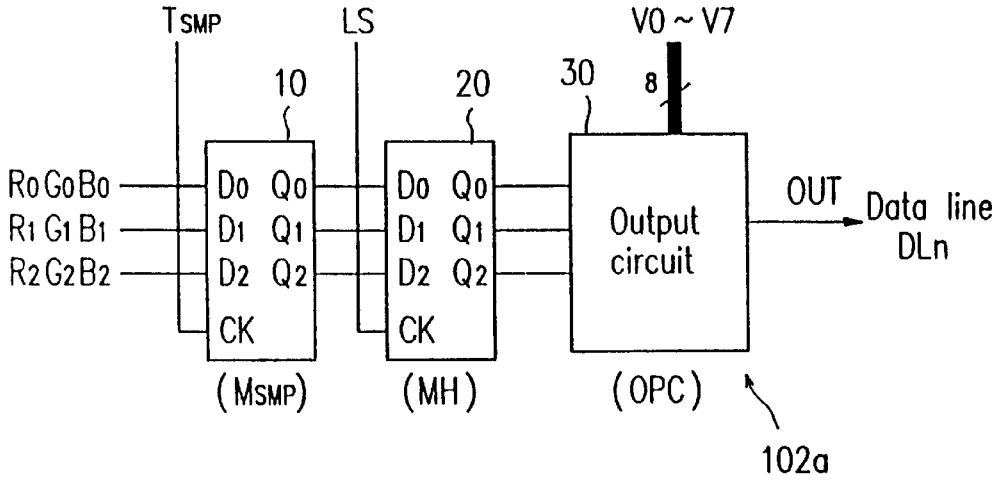
FIG. 1A is a block diagram showing a part of a conventional 3-bit digital driver corresponding to one output.
Figure 1B:
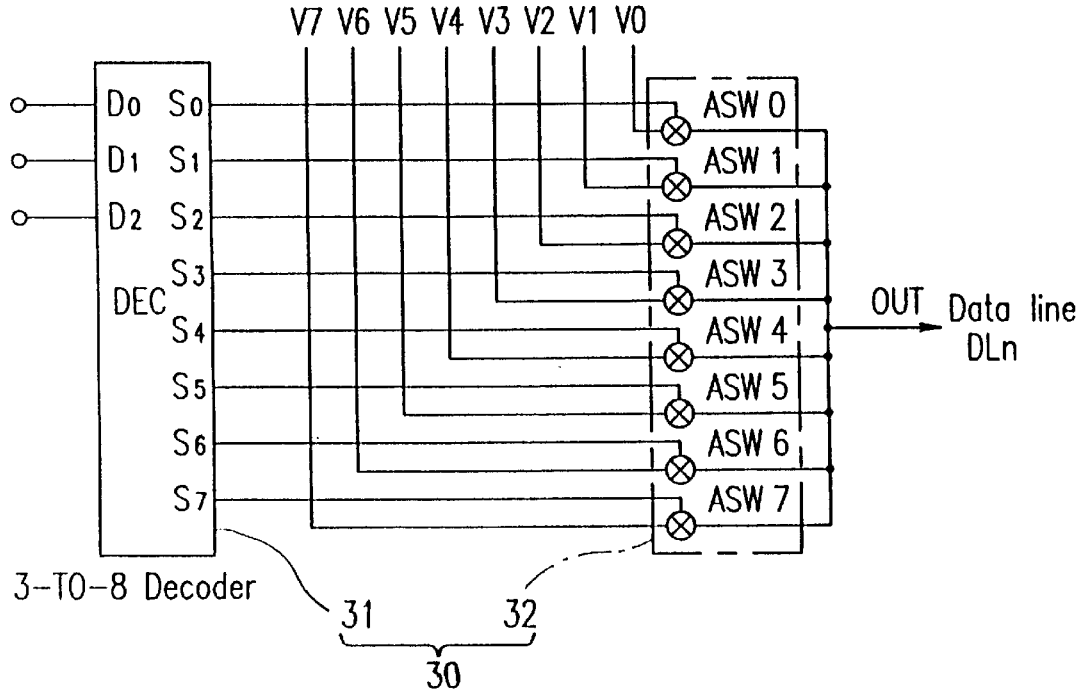
PRIOR ART FIG. 1B
FIG. 1B is a circuit diagram of an output circuit of the 3-bit digital driver shown in FIG. 1A.
Figure 2:
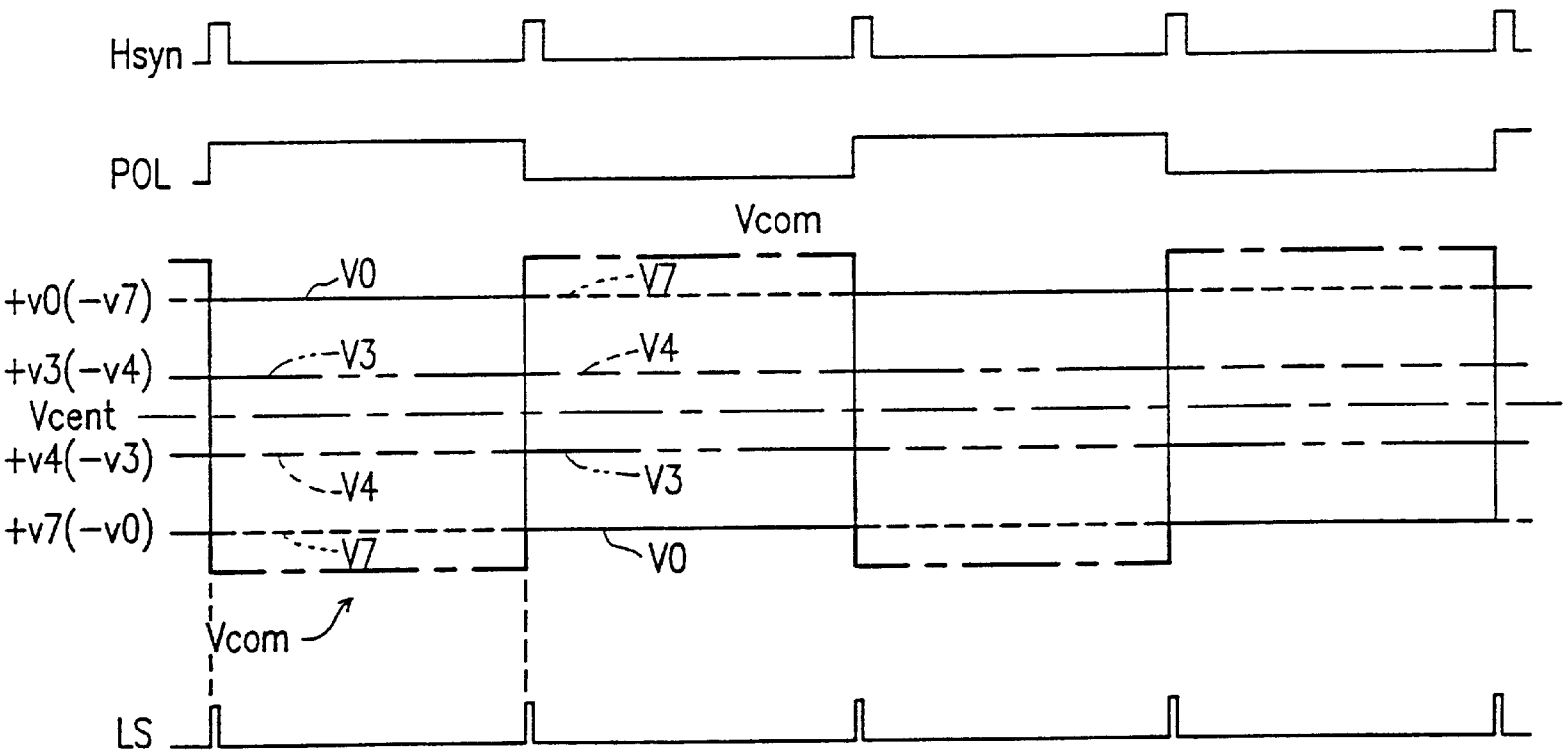
FIG. 2 is a timing diagram illustrating the waveforms of signals for driving a liquid crystal panel by the 3-bit digital driver shown in FIG. 1A.
Figure 3:
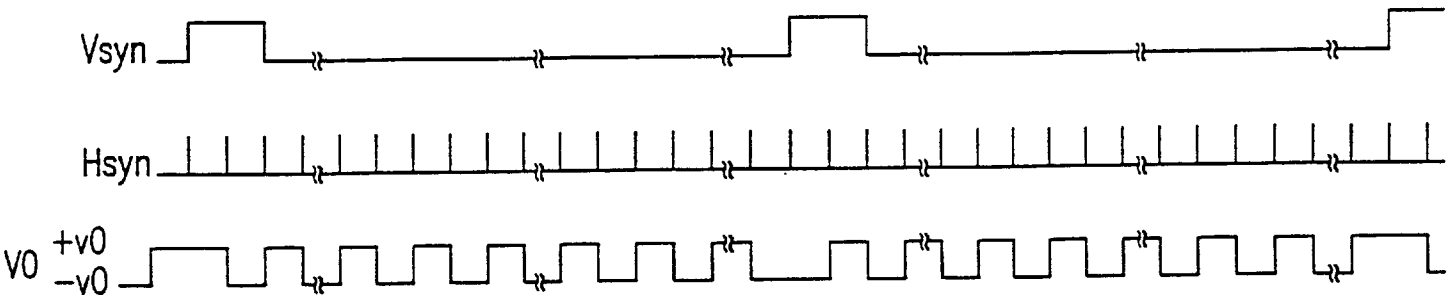
FIG. 3 PRIOR ART
FIG. 3 is a timing diagram showing a waveform of a gray scale signal in two frames together with the Vsyn and Hsyn signal.
Figure 4:
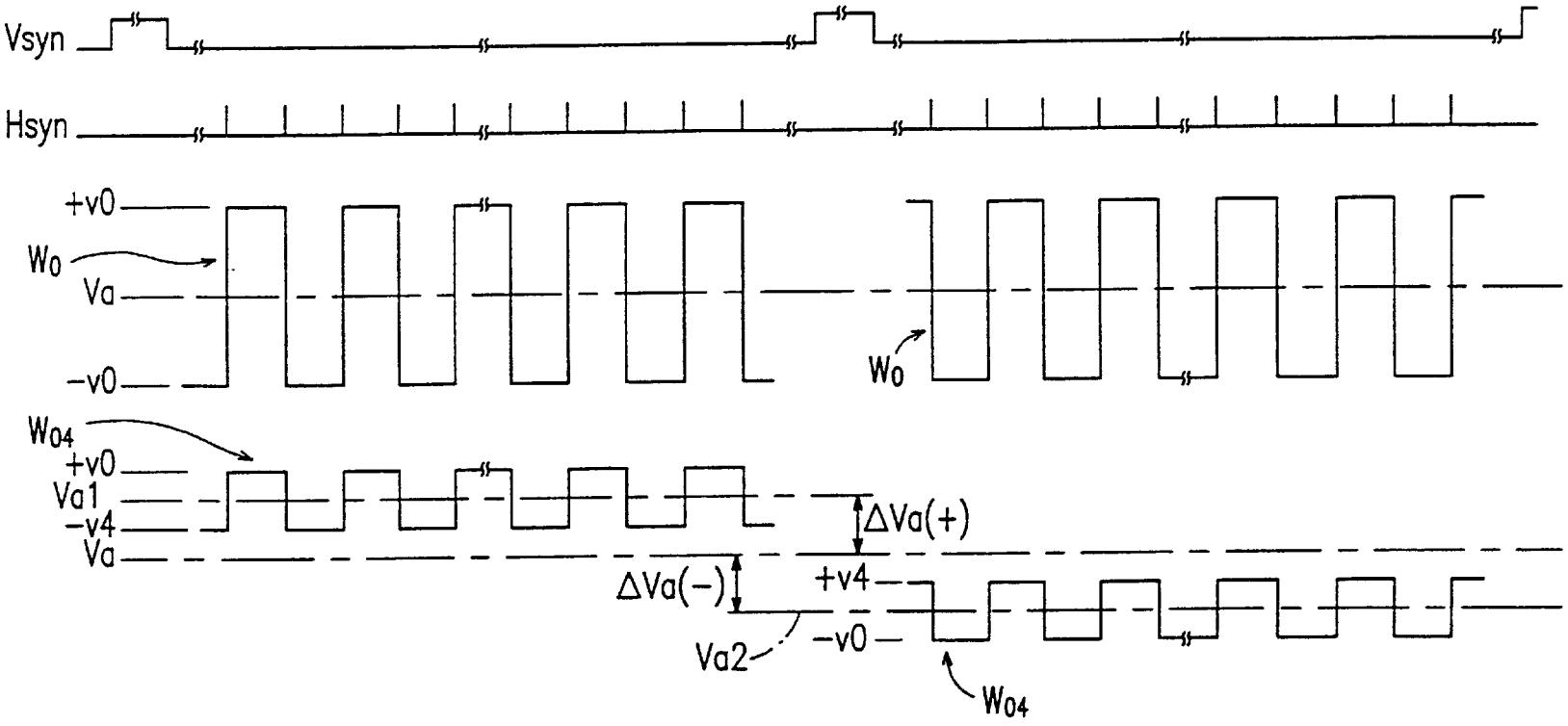
FIG. 4 is a timing diagram illustrating the waveform for writing one type of image data and the waveforms for writing two types of image data for two frames.

The LCD 100 further includes a driving voltage generator 104, for generating eight types of gray scale voltages V0 through V7 and a common electrode voltage, a data driver 102 for applying the gray scale voltage corresponding to the data of the image to be displayed, and a gate driver 103 for sequentially driving the gate lines 1 based on an Hsyn signal. The data driver 102 includes a plurality of unit drivers 102*a* shown in FIG. 1A. The number of the unit drivers 102*a* is equal to the number of data lines 2.

The LCD 100 still further includes a controller 105 for receiving image data, an Hsyn signal and a Vsyn signal and controlling the data driver 102, the gate driver 103 and the gray scale voltage generator 104.

Figure 8B:
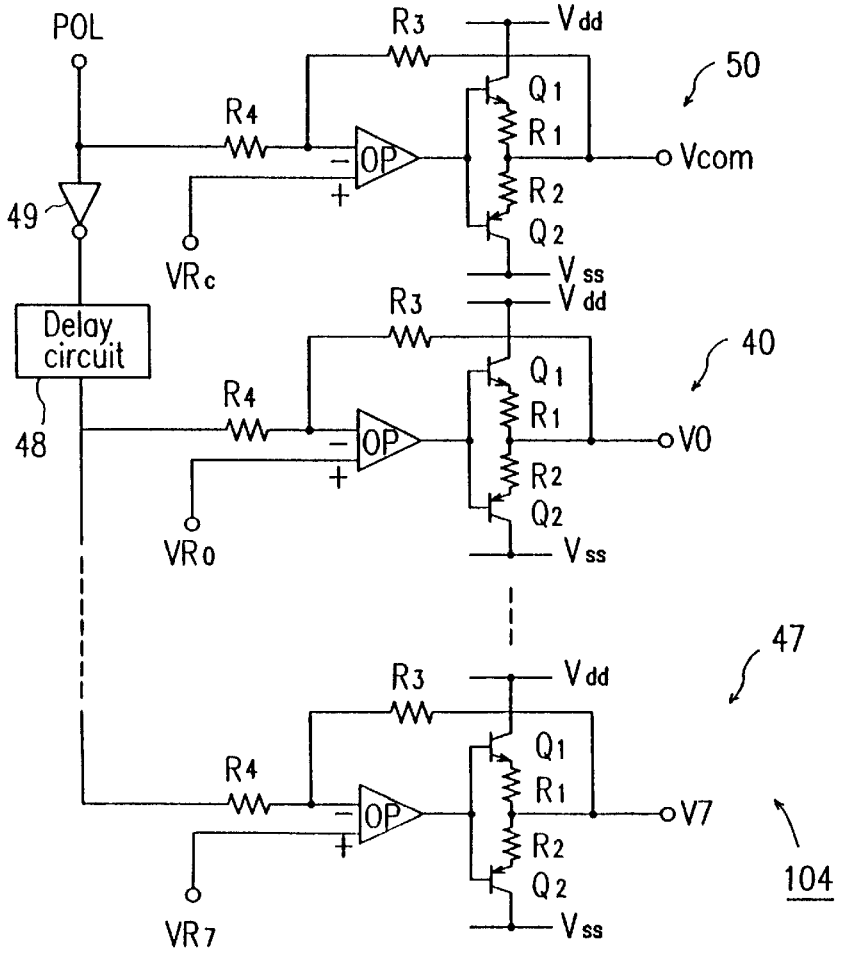
FIG. 8B is a circuit diagram of a gray scale voltage generator of the driving circuit shown in FIG. 8A.

FIG. 8B shows a circuit configuration of the gray scale voltage generator 104.

As shown in FIG. 8B, the gray scale voltage generator 104 includes a common electrode voltage generator 50 for generating a common electrode voltage, gray scale voltage generators 40 through 47 for generating gray scale voltages V0 through V7, an inverter 49 for inverting a polarity (POL) signal, and a delay circuit 48 for delaying the inverted POL signal. In FIG. 8B, only two gray scale voltage generators 40 and 47 are shown for simplicity.

The common electrode voltage generator 50 and the gray scale voltage generators 40 through 47 each include a high potential power line Vdd, a low potential power line Vss, resistors R1 and R2, transistors Q1 and Q2, and an operational amplifier OP. The resistors R1 and R2 and the transistors Q1 and Q2 are connected in series between the high and low potential power lines Vdd and Vss. An output of the operational amplifier OP is connected to a common base of the transistors Q1 and Q2. The transistor Q1 and Q2 are used to form a current amplifier.

Each of the voltage generators 50 and 40 through 47 further includes a resistor R3 connected between an output of the current amplifier and an inverting input of the operational amplifier OP, and a resistor R4 connected between the inverting input of the operational amplifier OP and the circuit on the previous stage. In FIG. 8B, VRc, VR0 and VR7 represent voltages to be applied to the non-inverting inputs of the operational amplifiers OP.

In each of the voltage generators 50 and 40 through 47, the amplification ratio of the operational amplifier OP is set to a prescribed value so that prescribed gray scale voltages are output.

The common electrode voltage Vcom and the gray scale voltages V0 through V7 are inverted by the POL signal gate line by gate line and frame by frame. The gray scale voltages are applied to the data lines so that the average potential of each data line in each of the frames is maintained within a certain range regardless of the image to be displayed on the liquid crystal panel. Specifically, the POL signal to be applied to the gray scale voltage generators 40 through 47 is delayed by the delay circuit 48. Thus, the inverting timing of the polarity of the POL signal is delayed by, for example, 180 degrees; i.e., the inverting timing of the gray scale voltages V0 through V7 is delayed with respect to the timing of the latch strobe signal or output pulses LS by 180 degrees. In this specification, the inverting timing of the polarity may be referred to as a "polarity inverting timing".

The LCD 100 operates in the following manner.

Figure 9:
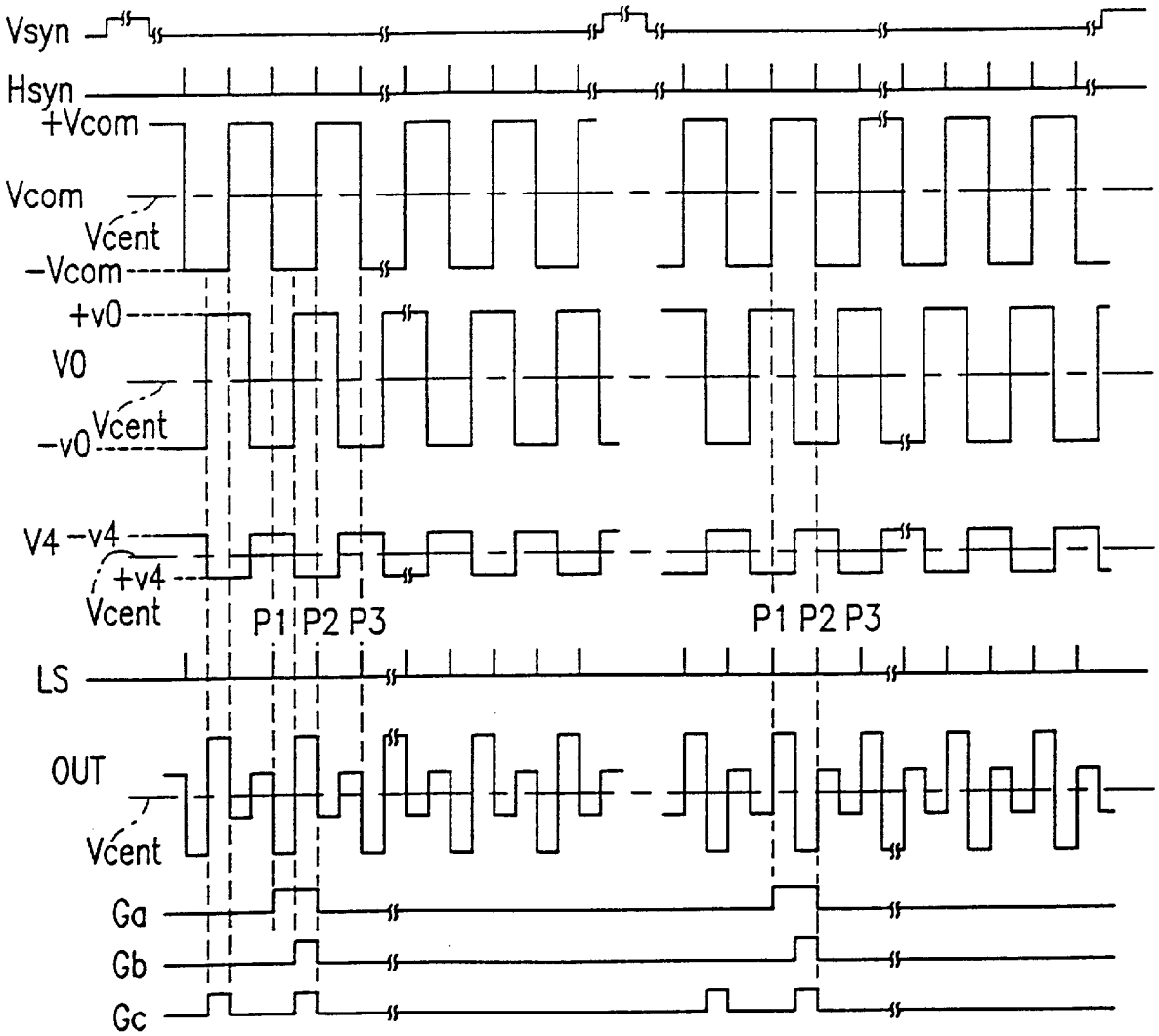
FIG. 9 is a timing diagram illustrating signals for driving a liquid crystal panel included in the LCD shown in FIG. 8A by a method in a first example according to the present invention.

FIG. 9 is a timing diagram of the signals for driving the liquid crystal panel 101 (FIG. 8A); more particularly, for writing image data "0" and "4" into a pixel connected to one data line.

The gray scale voltages V0 (representing the image data "0") and V4 (representing the image data "4") are alternately output from the gray scale voltage generator 104, and the inverting timing thereof is delayed with respect to the timing of the output pulses LS by 180 degrees. (A period between one output pulse and the next output pulse is considered to be 360 degrees.) The gray scale voltages V0 and V4 have rectangular waveforms. Signal OUT is an output from the data driver 102.

The light transmittance of each of pixels in the liquid crystal panel 101 is determined by the potential difference between the common electrode and the pixel electrode. Accordingly, the common electrode voltage also needs to be considered in order to obtain a desired light transmittance of the pixel. In this example, the inverting timing of the polarity of the common electrode voltage Vcom is substantially in phase with the timing of the output pulses LS.

Signals Ga, Gb and Gc are outputs from the gate driver 103. Although FIG. 9 shows the signals to be sent to one gate line 3, it can be appreciated that signals are sent to the other gate lines 3 at the same timing. The signal Ga is in phase with the output pulses LS, and turns the switching device 4 on and off as in the conventional driver. Chain line Vcent represents the center value of each of the voltages.

Figure 10:
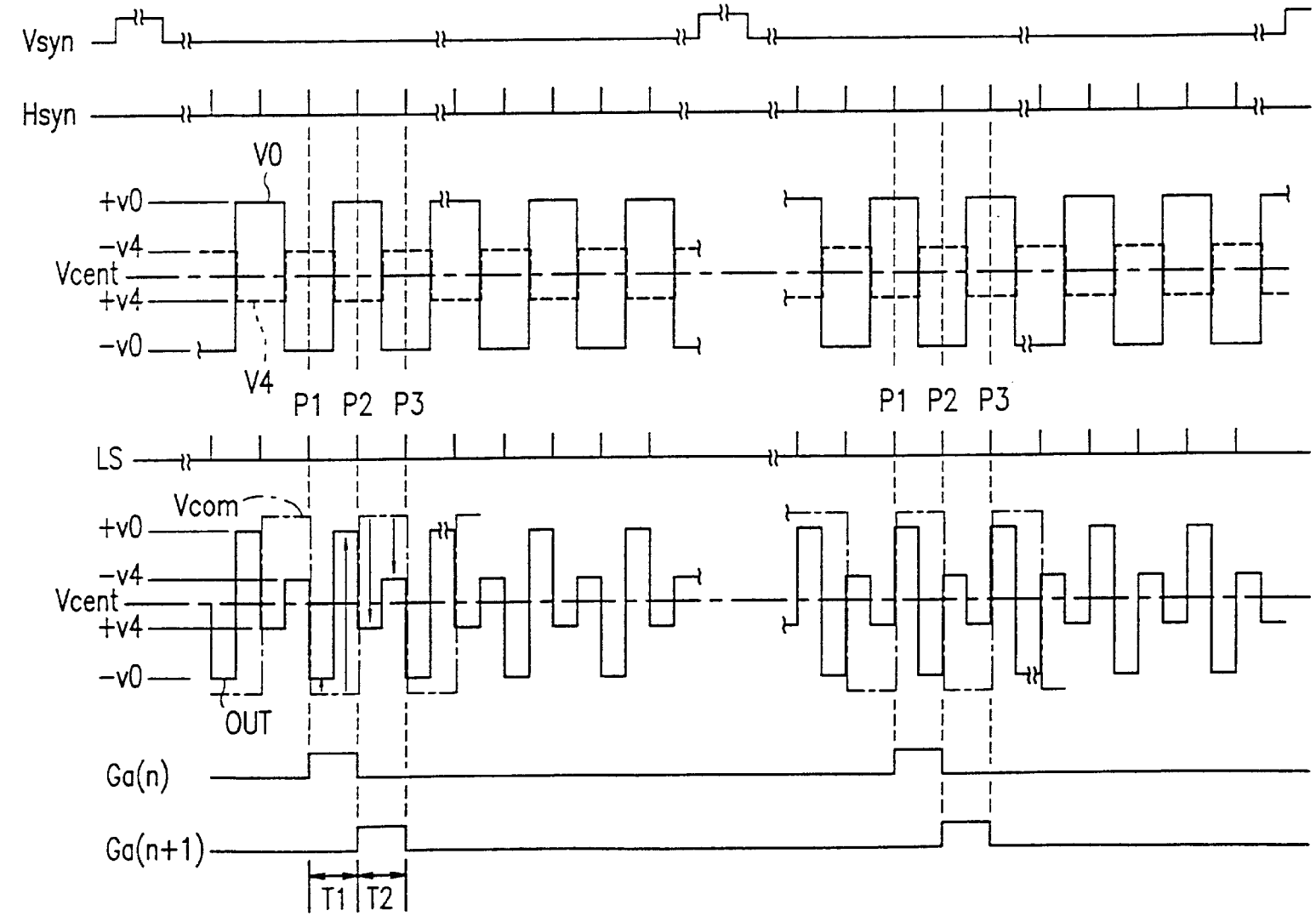
FIG. 10 is a timing diagram for explaining the driving method in the first example in more detail.

With reference to FIG. 10, the driving method in the first example will be described in detail.

The gray scale voltages V0 and V4 are shown in a superimposed state, and the signal OUT from the data driver 102 and the common electrode voltage Vcom are shown in a superimposed state. Signals Ga(n) and Ga(n+1) are outputs from the gate driver 103 to two adjacent gate lines 3.

As described above, in this specification, a period in which data corresponding to the n'th gate line is output from the data driver 102 is referred to as an "output period". A period in which the n'th gate line is "ON" is referred to as a "driving period". A time period in which the voltage to be applied to the pixel electrode is higher (positive) with respect to the common electrode voltage Vcom is referred to as a "positive driving period", and a time period in which the voltage to be applied to the pixel electrode is lower (negative) with respect to the common electrode voltage Vcom is referred to as a "negative driving period".

In the first example, a time period in which the signal Ga(n) is "high" is referred to as a driving period "T1", and a time period in which the signal Ga(n+1) is "high" is referred to as a driving period "T2". The driving period "T1" corresponds to a period between output a first output pulse P1 and a second output pulse P2, and the driving period "T2" corresponds to a period between the second output pulse P2 and a third output pulse P3. Thus, the driving period corresponds to the output period defined by the output pulses LS.

When the first output pulse P1 is input to the data driver 102 (FIG. 8A), the image data "0" is held by the holding memory 20 in the unit driver 102*a* (FIG. 1A), and the output circuit 30 of the data driver 102 continues outputting a gray scale voltage V0 as a driving voltage during the driving period T1, namely, until the second output pulse P2 is input. When the second output pulse P2 is input to the data driver 102, the image data "4" is held by the holding memory 20, and the output circuit 30 of the data driver 102 continues outputting a gray scale voltage V4 as a driving voltage during the driving period T2, namely, until the third output pulse P3 is input.

Since the inverting timing of the gray scale voltages V0 and V4 is delayed with respect to the timing of the output pulses LS by 180 degrees, the data driver 102 outputs the gray scale voltages V0 and V4 for driving the pixel electrode in the following manner.

During the first half of the driving period T1, the gray scale voltage V0 has a negative potential of −v0 (which is higher than the common electrode voltage Vcom as represented by the upward arrow). During the second half of the driving period T1, the gray scale voltage V0 obtains a desired positive potential of +v0 (higher than the common electrode Vcom) corresponding to the image data "0" used for display. This voltage is kept until the gate electrode is turned off.

During the first half of the driving period T2, the gray scale voltage V4 has a positive potential of +v4 (which is lower than the common electrode voltage Vcom as represented by the downward arrow). During the second half of the driving period T2, the gray scale voltage V4 obtains a desired negative potential of −v4 (lower than the common electrode voltage Vcom) corresponding to the image data "4" used for display. This voltage is maintained until the gate electrode is turned off. In the next frame, the polarities of the gray scale voltages V0 and V4 and the common electrode voltage Vcom are opposite to those in this frame.

In this example, a phase difference is generated between the inverting timing of the gray scale voltages and the timing of the output pulses LS, i.e., the timing of the data output from the data driver 102. Specifically, the inverting timing of the gray scale voltages is delayed with respect to the timing of the output pulses LS, and moreover the common electrode voltage Vcom is in phase with the output pulses LS. Accordingly, the pixel electrode can be charged with a desired potential.

Due to the delay of the inverting timing of the gray scale voltage with respect to the timing of the output pulses LS, the gray scale voltage corresponding to image data which is output by the data driver 102 has a positive potential and a negative potential within one driving period T. Since the delay is 180 degrees, the period in which the positive potential is output and the period in which the negative potential is output are equal. As a result, the average potential of the gray scale voltage is equal to the center value Vcent of the gray scale voltage.

As the delay increases or decreases from 180 degrees, the difference of the average potential of the gray scale voltage from the center value Vcent enlarges. As long as such a difference is not large enough to adversely influence the image quality, the delay can be larger or smaller than 180 degrees. The maximum possible difference is determined by the required image quality and the characteristics of the display medium or the liquid crystal panel.

Specifically, the range of delay can be determined in the following manner. For example, a first pixel electrode and a second pixel electrode connected to an identical data line are charged in a first frame. The potential of the first pixel electrode is different from a prescribed potential by a change in the average potential of the data line. The potential of the second pixel electrode is also different from the prescribed potential by the change in the average potential of the data line. As long as the relationship between these differences does not have any substantial influence on the luminance on the liquid crystal panel, the delay can be different from 180 degrees.

In actual driving circuit systems, the center value of the common electrode voltage Vcom is often designed to be slightly different from the center value of the gray scale voltage in order to compensate for characteristic differences of the liquid crystal panel with respect to a plurality of gray scale voltages. The present invention is applicable in such a case.

Figure 5A:
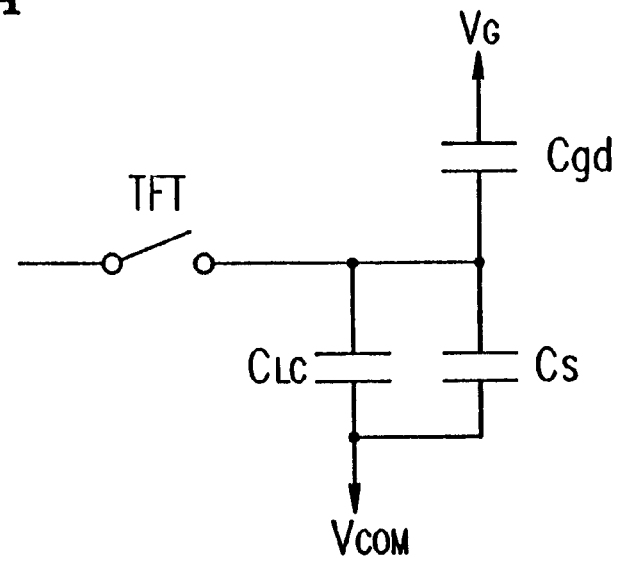
FIG. 5A is an equivalent circuit of a pixel.
Figure 5B:
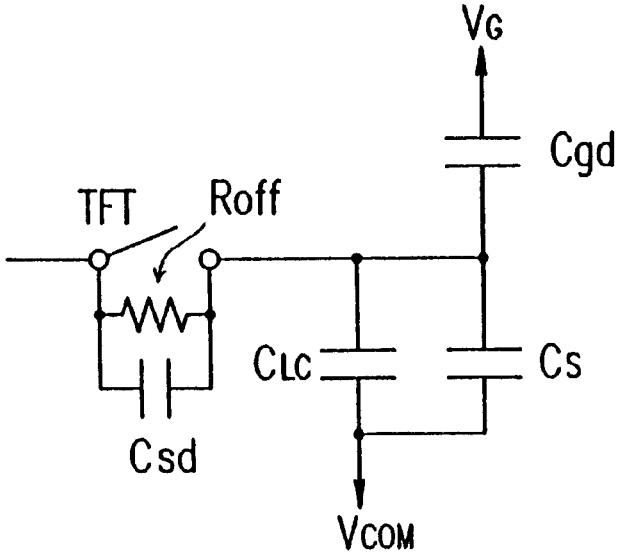
PRIOR ART FIG. 5B
FIG. 5B is an equivalent circuit of a pixel including an off-state resistance and a source-drain capacitance of a TFT.
Figure 6A:
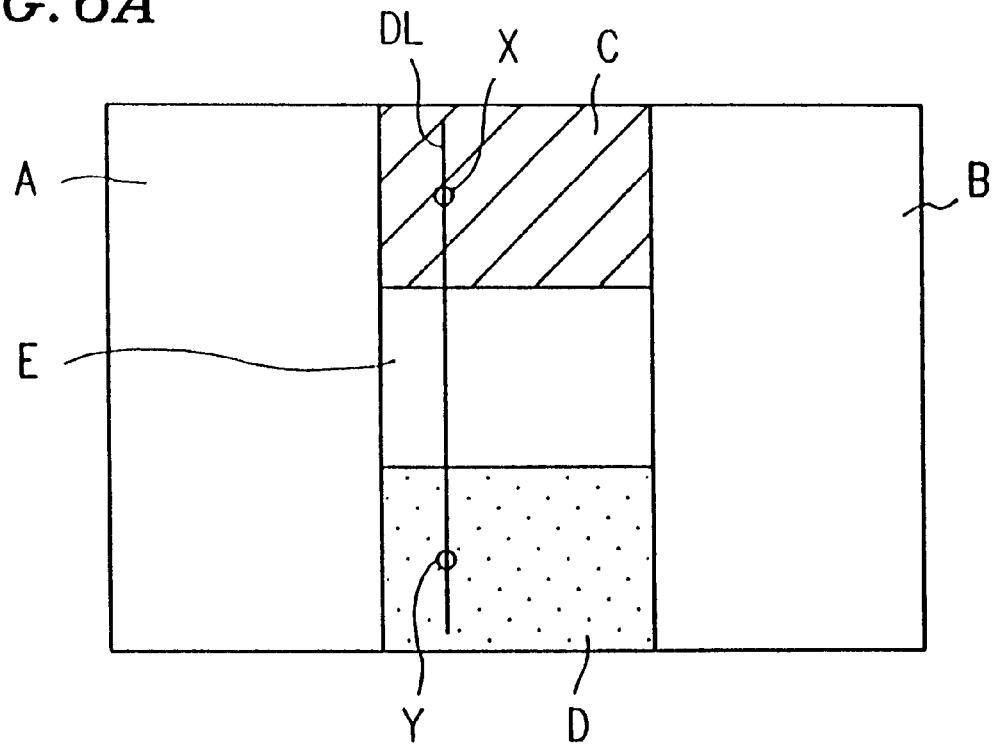
FIG. 6A shows a screen displaying an image pattern having a non-uniform luminance.
Figure 6B:
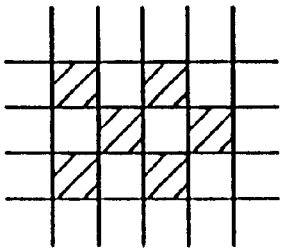
PRIOR ART FIG. 6B
FIG. 6B shows an area having the non-uniform luminance in detail.
Figure 7:
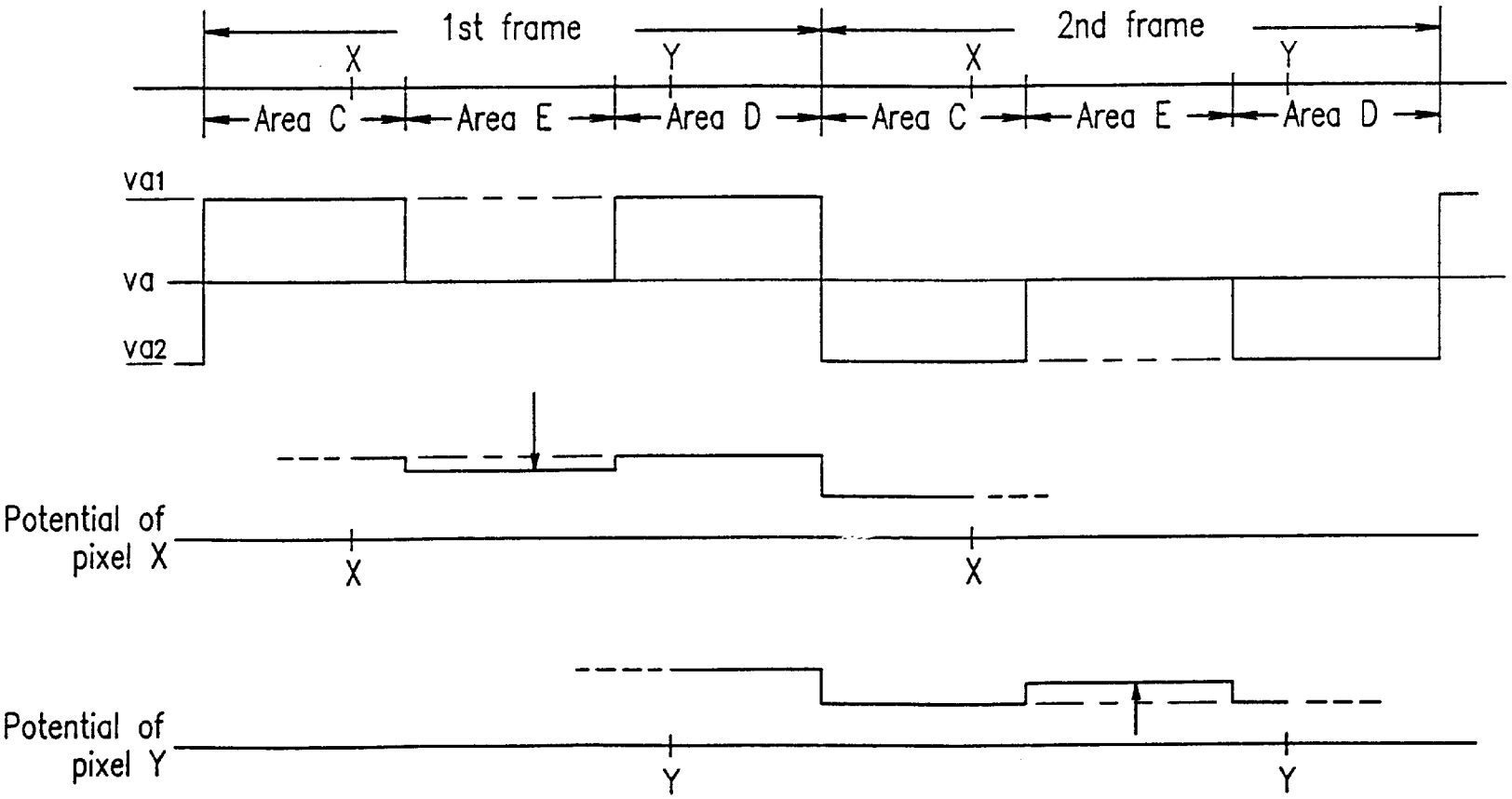
FIG. 7 is a timing diagram illustrating the potentials of pixel electrodes in different areas of the same image.

By the method in the first example, the average potential of the data line is maintained at the center value Vcent of the gray scale voltage or in the vicinity thereof regardless of the potentials of the gray scale voltage, namely, regardless of the image pattern to be displayed. Accordingly, influences exerted on the pixel by the potential of the data line through the source-drain capacitance Csd or the off-state resistance Roff (FIG. 5B) are maintained constant regardless of the image pattern to be displayed. As a result, the display quality is always kept the same.

In the first example, in the first half of the driving period T1, the potential of the driving voltage is positive (i.e., higher) with respect to the common electrode voltage Vcom as described above, and the polarity of the desired gray scale voltage corresponding to the image data used for display is also positive with respect to the common electrode voltage Vcom. In the driving period T2, the potential of the driving voltage in the first half and the potential of the desired voltage are both negative with respect to the common electrode voltage Vcom. Accordingly, the voltage applied in the first half of each driving period can be utilized to a certain extent for obtaining the desired voltage without being completely wasted. Such a manner of voltage application is advantageous for certain types of display mediums.

The output from the data driver 102 is used for charging the pixel electrode in only about half of the time period compared to the time period allowed by the conventional method. Nonetheless, due to the rapid development in design and production method of display mediums using liquid crystal, liquid crystal panels generally used today can be charged in less than half the time compared to the liquid crystal panels used several years ago.

For example, VGA-type liquid crystal panels commonly used several years ago require at least 30 $\mu$s to be sufficiently charged, which is slightly less than one horizontal period. A VGA-type liquid crystal panel which can be charged in about 10 $\mu$s can be realized today. Such a short period of charging time compensates for the limited charging time allowed by the driving method in the first example.

Referring to FIG. 9 again, the signals Gb and Gc are also outputs from the gate driver 103. The signal Gb is in phase with the second half of the signal OUT from the data driver 102 (the part mainly contributing to the charge of the pixel electrode), and turns the switching device 4 on and off. The signal Gc becomes "high" in every other driving period, which provides the following advantage.

A polarity of the voltage to be applied across a part of the liquid crystal layer corresponding to a pixel is inverted frame by frame. Accordingly, if one driving period is a positive driving period in one frame, the potential of the pixel electrode is negative with respect to the common electrode voltage Vcom in the corresponding driving period in the next frame. In each frame, two adjacent gate lines are supplied with voltages having opposite polarities. Accordingly, the polarity of the voltages output from the data driver 102 is inverted every driving period T.

Therefore, while an output from the gate driver 103 to one gate line, for example, the output Ga(n) is "high", the pixel electrode, which has been charged with a negative voltage, is now charged with a positive voltage corresponding to image data before the previous image data. Due to such a system, the next time when the output Ga(n) becomes "high", the pixel electrode has already been charged with the positive voltage and is charged with another positive voltage corresponding to the next image data. Accordingly, the time period required for charging the pixel electrode is shortened, which compensates for the above-described inconvenience of the method in the first example that the output from the data driver 102 contributes to the charge of the pixel electrode in only half of the time period compared to the time period allowed by the conventional method. This is especially advantageous for a liquid crystal panel which cannot be sufficiently charged within half of the time of the time period allowed by the conventional method.

Moreover, since the gate electrode goes from "high" to "low" in phase with the end of each output period, each pixel electrode can be prevented from being charged with a gray scale voltage corresponding to the next pixel electrode.

As described above, in the first example, the inverting timing of the gray scale voltages V0 through V7 is delayed with respect to the timing of the output pulses LS by 180 degrees. Due to such a delay, whichever output from the gate driver Ga, Gb or Gc is used, the image quality is kept sufficient without being influenced by the potential of the data line through the source-drain capacitance Csd or the off-state resistance Roff of the TFT used as the switching device 4.

EXAMPLE 2

Figure 11:
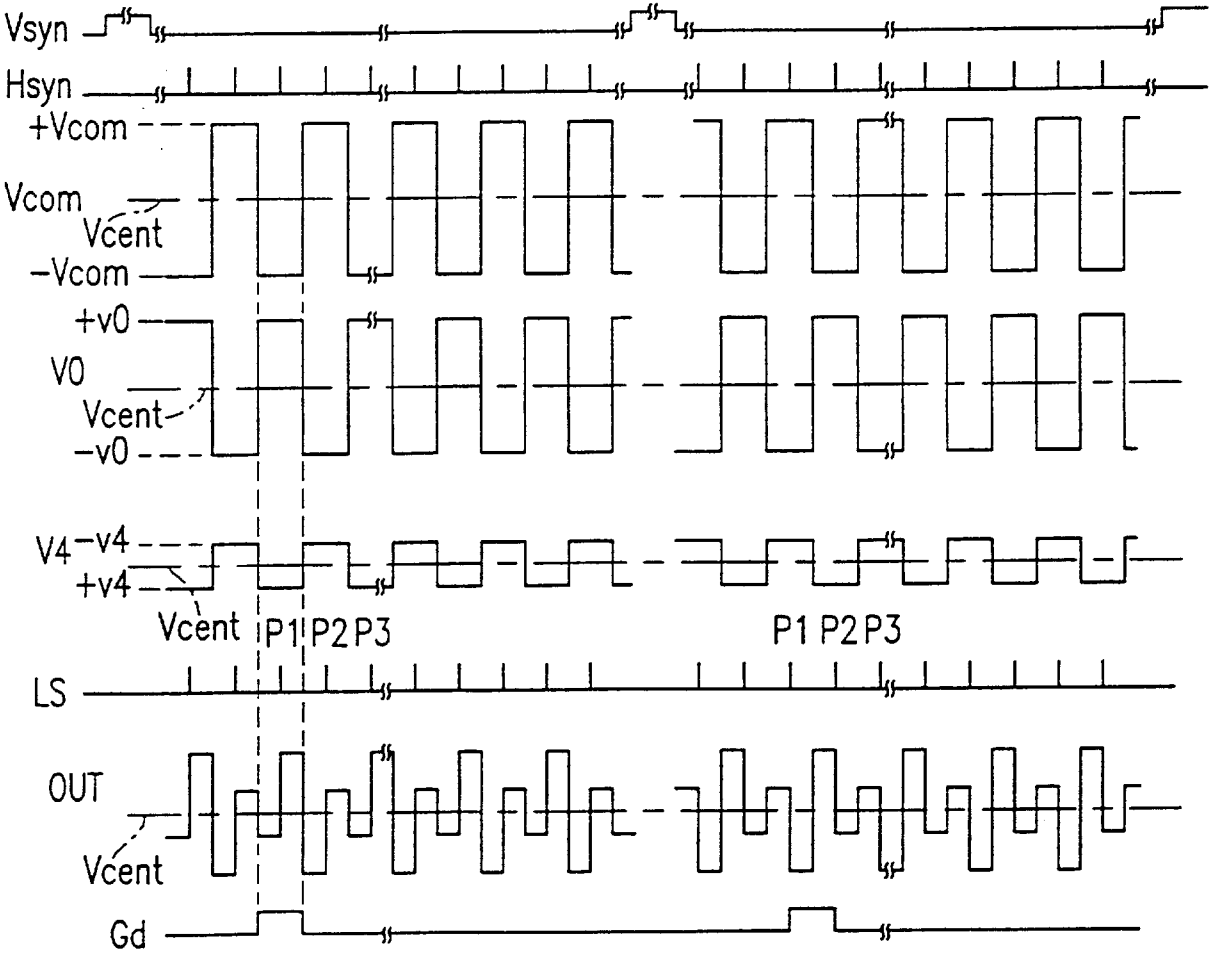
FIG. 11 is a timing diagram illustrating signals for driving the liquid crystal panel by a method in a second example according to the present invention.

FIG. 11 is a timing diagram of the signals for driving the liquid crystal panel 101 (FIG. 8A); more particularly, for writing image data "0" and "4" into a pixel connected to one data line by a method in a second example according to the present invention.

In this example, the inverting timing of the gray scale voltages V0 (representing the image data "0") and V4 (representing the image data "4") is advanced with respect to the timing of the output pulses LS by 180 degrees. The inverting timing of the common electrode voltage Vcom is also advanced with respect to the timing of the output pulses LS by 180 degrees.

The gray scale voltage generator used for the method in the second example has a slightly different configuration from that of the gray scale voltage generator 104 shown in FIG. 8B. The gray scale voltage generator used in the second example includes another delay circuit, through which a POL signal is supplied to the inverting input of the operational amplifier OP of the common electrode voltage generator 50. By such an additional delay circuit and the delay circuit 48 shown in FIG. 8B, the POL signal is delayed by the time period required for the inverting timing of the common electrode voltage Vcom and the inverting timing of the gray scale voltages V0 through V7 to be advanced with respect to the timing of the output pulses LS by 180 degrees.

Signal Gd is an output from the gate driver 103. The signal Gd is also advanced with respect to the timing of the output pulses LS, and turns the switching device 4 on and off.

Figure 12:
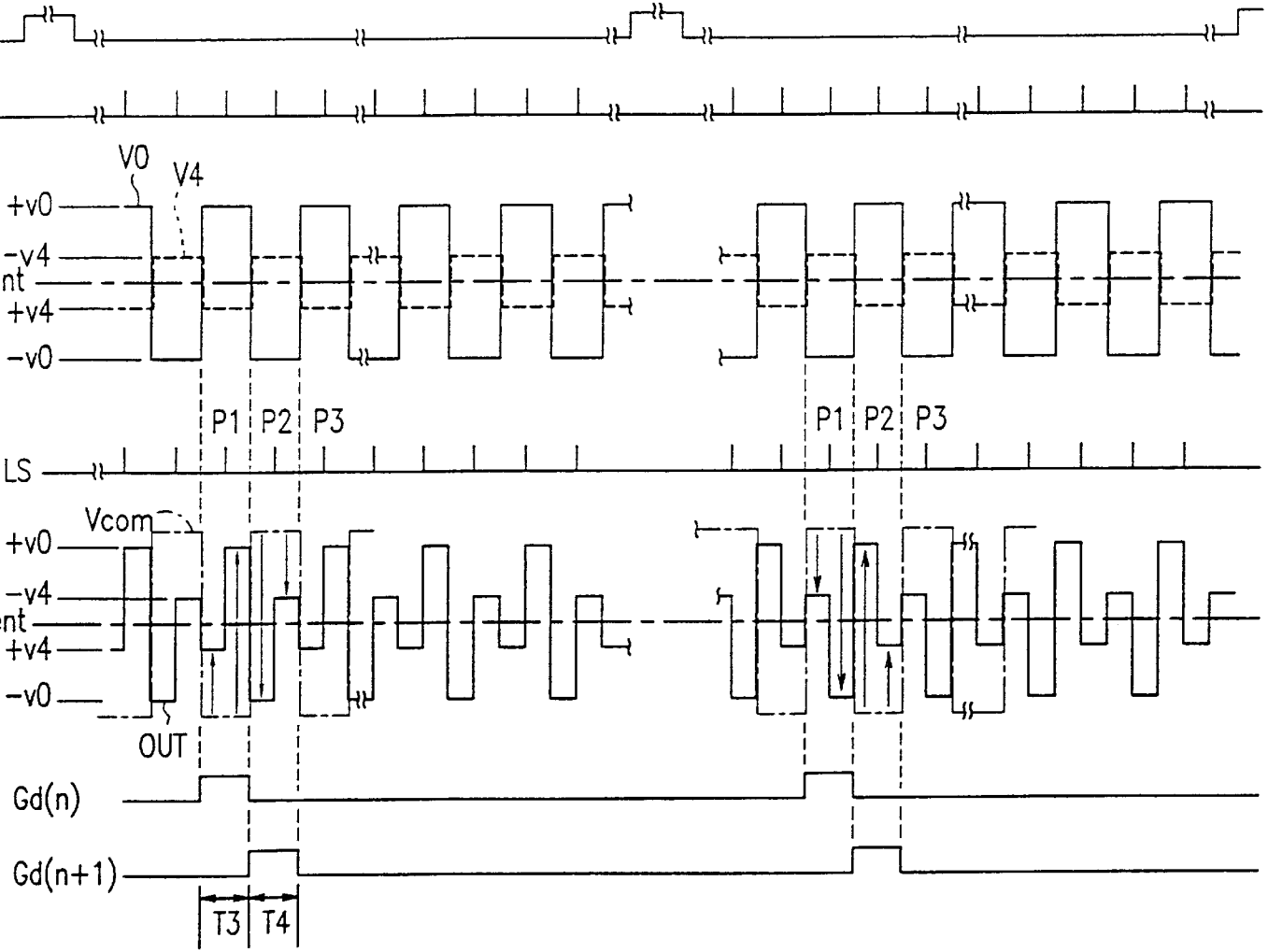
FIG. 12 is a timing diagram for explaining the driving method in the second example in more detail.

With reference to FIG. 12, the driving method in the second example will be described in detail.

The gray scale voltages V0 and V4 are shown in a superimposed state, and the signal OUT from the data driver 102 and the common electrode voltage Vcom are shown in a superimposed state. Signals Gd(n) and Gd(n+1) are outputs from the gate driver 103 to two adjacent gate lines 3.

In the second example, a time period in which the signal Gd(n) is "high" is referred to as a driving period "T3", and a time period in which the signal Gd(n+1) is "high" is referred to as a driving period "T4". The driving period "T3" corresponds to a period having a second output pulse P1 as the center, and the driving period "T4" corresponds to a period having a second output pulse P2 as the center.

During the first half of the driving period T3, the pixel electrode is charged with a gray scale voltage V4 having a positive potential of +v4 (which is higher than the common electrode voltage Vcom as represented by the upward arrow). During the second half of the driving period T3, the pixel electrode is charged with a gray scale voltage V0 having a desired positive potential of +v0 (higher than the common electrode voltage Vcom) corresponding to the image data "0" used for display. This voltage is maintained until the gate electrode is turned off.

During the first half of the driving period T4, the pixel electrode is charged with the gray scale voltage V0 having a negative potential of −v0 (which is lower than the common electrode voltage Vcom as represented by the downward arrow). During the second half of the driving period T4, the pixel electrode is charged with the gray scale voltage V4 having a desired negative potential −v4 (lower than the common electrode voltage Vcom) corresponding to the image data "4" used for display. This voltage is kept until the gate electrode is turned off. In the next frame, the polarities of the gray scale voltages V0 and V4 and the common electrode voltage Vcom are opposite to those in this frame.

In this example, the inverting timing of the gray scale voltages is advanced with respect to the timing of the output pulses LS by 180 degrees, and the inverting timing of the common electrode voltage Vcom is also advanced with respect to the timing of the output pulses LS by 180 degrees. Accordingly, the average potential of the data line is maintained at the center value Vcent of the gray scale voltage or in the vicinity thereof regardless of the potentials of the gray scale voltage, namely, regardless of the image pattern to be displayed. As a result, the image quality is maintained regardless of the image pattern to be displayed.

The advance of the gray scale voltages V0 through V7 and the common electrode voltage Vcom can be larger or smaller than 180 degrees in accordance with the required image quality and the characteristics of the liquid crystal panel.

In the second example, in the first half of the driving period T3, the potential of the driving voltage is positive (i.e., higher) with respect to the common electrode voltage Vcom as described above, and the polarity of the desired gray scale voltage corresponding to the image data used for display is also positive with respect to the common electrode voltage Vcom. In the driving period T4, the potential of the driving voltage in the first half and the potential of the desired voltage are both negative with respect to the common electrode voltage Vcom.

Therefore, a pixel electrode, which has been charged with a negative voltage, is charged with a voltage having the same polarity as that of the desired voltage in the first half of each driving period and then is charged with the desired voltage in the second half of the driving voltage. Due to such a system, the time period in which the gate electrode is ON can be entirely used for charging the pixel electrode.

Moreover, the method in the second example, by which each pixel electrode can be prevented from being charged with voltages having opposite polarities in one output period, is more preferable.

Furthermore, since the gate electrode goes from "high" to "low" in phase with the polarity inverting timing of the gray scale voltage, each pixel electrode can be prevented from being charged with a gray scale voltage having a polarity opposite to the desired polarity.

EXAMPLE 3

Figure 13:
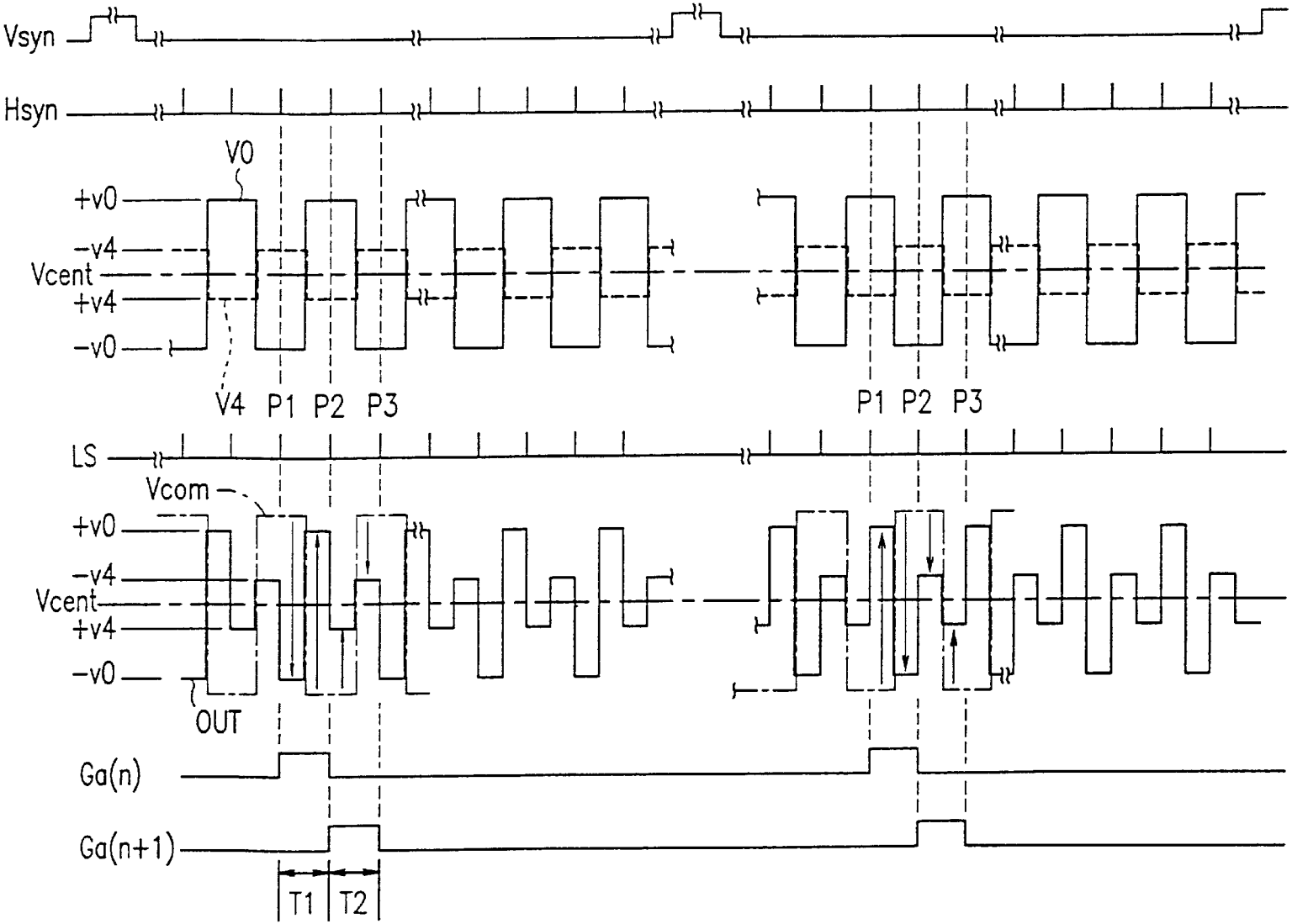
FIG. 13 is a timing diagram illustrating signals for driving the liquid crystal panel by a method in a third example according to the present invention.

FIG. 13 is a timing diagram of the signals for driving the liquid crystal panel 101 (FIG. 8A); more particularly, for writing image data "0" and "4" into a pixel connected to one data line by a method in a third example according to the present invention. The gray scale voltages V0 and V4 are shown in a superimposed state, and the signal OUT from the data driver 102 and the common electrode voltage Vcom are shown in a superimposed state.

In this example, the inverting timing of the gray scale voltages V0 (representing the image data "0") and V4 (representing the image data "4") and the inverting timing of the common electrode voltage Vcom are both delayed with respect to the timing of the output pulses LS by 180 degrees.

The gray scale voltage generator used for the method in the third example has a slightly different configuration from that of the gray scale voltage generator 104 shown in FIG. 8B. The gray scale voltage generator used in the third example includes another delay circuit, through which a POL signal is supplied to the inverting input of the operational amplifier OP of the common electrode voltage generator 50. By such an additional delay circuit and the delay circuit 48 shown in FIG. 8B, the POL signal is delayed by the time period required for the inverting timing of the common electrode voltage Vcom and the inverting timing of the gray scale voltages V0 through V7 to be delayed with respect to the timing of the output pulses LS by 180 degrees.

Signal Ga is an output from the gate driver 103. The signal Ga is in phase with the output pulses LS, and turns the switching device 4 on and off. Signals Ga(n) and Ga(n+1) are outputs from the gate driver 103 to two adjacent gate lines 3.

In the third example, a time period in which the signal Ga(n) is "high" is referred to as an output period "T1", and a time period in which the signal Ga(n+1) is "high" is referred to as an output period "T2". The output period "T1" corresponds to a period between a first output pulse P1 and a second output pulse, and the output period "T2" corresponds to a period between the second output pulse P2 and a third output pulse P3. Thus, the period in which the gate electrode is "ON" corresponds to the output period defined by the output pulses LS.

During the first half of the output period T1, the pixel electrode is charged with a gray scale voltage V0 having a negative potential of −v0 (which is lower than the common electrode voltage Vcom as represented by the downward arrow). During the second half of the output period T1, the pixel electrode is charged with the gray scale voltage V0 having a desired positive potential of +v0 (higher than the common electrode voltage Vcom) corresponding to the image data "0" used for display. This voltage is kept until the gate electrode is turned off.

During the first half of the output period T2, the pixel electrode is charged with a gray scale voltage V4 having a positive potential of +v4 (which is higher than the common electrode voltage Vcom as represented by the upward arrow). During the second half of the output period T2, the pixel electrode is charged with the gray scale voltage V4 having a desired negative potential −v4 (lower than the common electrode voltage Vcom) corresponding to the image data "4" used for display. This voltage is kept until the gate electrode is turned off. In the next frame, the polarities of the gray scale voltages and the common electrode voltage are opposite to those in this frame. (In the third example, the second half of the output period T1 and the first half of the output period T2 are positive driving periods, and the first half of the output period T1 and the second half of the output period T2 are negative driving periods.)

In this example, the inverting timing of the gray scale voltages is delayed with respect to the timing of the output pulses LS by 180 degrees, and the inverting timing of the common electrode voltage Vcom is also delayed with respect to the timing of the output pulses LS by 180 degrees. Accordingly, the average potential of the data line is maintained at the center value Vcent of the gray scale voltage or in the vicinity thereof regardless of the potentials of the gray scale voltage, namely, regardless of the image pattern to be displayed. As a result, the image quality is maintained regardless of the image pattern to be displayed.

The delay of the gray scale voltages V0 through V7 and the common electrode voltage Vcom can be larger or smaller than 180 degrees in accordance with the required image quality and the characteristics of the liquid crystal panel.

In the third example, in the first half of the output period T1, the potential of the driving voltage is negative (i.e., lower) with respect to the common electrode voltage Vcom as described above, but the polarity of the desired gray scale voltage corresponding to the image data used for display is positive with respect to the common electrode voltage Vcom. In the next output period T2, the potential of the driving voltage is positive (i.e., higher) with respect to the common electrode voltage Vcom as described above, but the polarity of the desired gray scale voltage is negative with respect to the common electrode voltage Vcom. Since the polarity in the first half of each output period is opposite to the polarity of the desired voltage with respect to the common electrode voltage Vcom, the driving waveforms in the first example may be preferable for certain types of display mediums.

EXAMPLE 4

Figure 14:
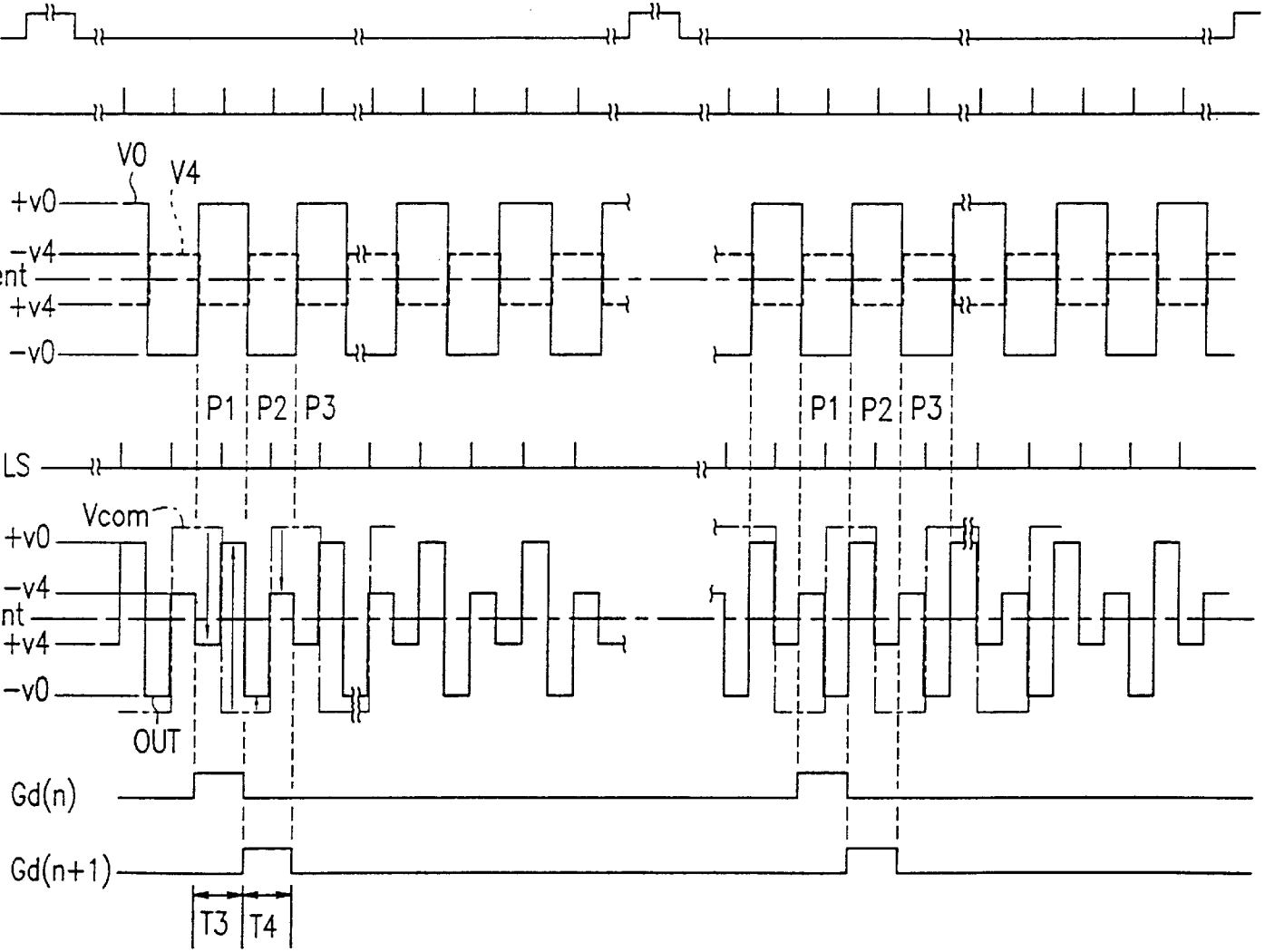
FIG. 14 is a timing diagram illustrating signals for driving the liquid crystal panel by a method in a fourth example according to the present invention.

FIG. 14 is a timing diagram of the signals for driving the liquid crystal panel 101 (FIG. 8A); more particularly, for writing image data "0" and "4" into a pixel connected to one data line by a method in a fourth example according to the present invention. The gray scale voltages V0 and V4 are shown in a superimposed state, and the output from the data driver 102 and the common electrode voltage Vcom are shown in a superimposed state.

In this example, the inverting timing of the gray scale voltages V0 (representing the image data "0") and V4 (representing the image data "4" ) is advanced with respect to the timing of the output pulses LS by 180 degrees, and the inverting timing of the common electrode voltage Vcom is in phase with the timing of the output pulses LS.

The gray scale voltage generator used for the method in the fourth example has the same configuration from that of the gray scale voltage generator 104 shown in FIG. 8B. The operation of the circuit is different from that in the first example in that the POL signal is delayed by the delay circuit 48 by the time period required for the inverting timing of the gray scale voltages V0 through V7 to be advanced with respect to the timing of the output pulses LS by 180 degrees.

Signal Gd is an output from the gate driver 103. The signal Gd is advanced with respect to the timing of the output pulses LS by 180 degrees, and turns the switching device 4 on and off. Signals Gd(n) and Gd(n+1) are outputs from the gate driver 103 to two adjacent gate lines 3.

In the fourth example, a time period in which the signal Gd(n) is "high" is referred to as an output period "T3", and a time period in which the signal Gd(n+1) is "high" is referred to as an output period "T4". The output period "T3" corresponds to a period having a first output pulse P1 as the center, and the output period "T3" corresponds to a period having the second output pulse P2 as the center.

During the first half of the output period T3, the pixel electrode is charged with a gray scale voltage V4 having a positive potential of +v4 (which is lower than the common electrode voltage Vcom as represented by the downward arrow). During the second half of the output period T3, the pixel electrode is charged with a gray scale voltage V0 having a desired positive potential of +v0 (higher than the common electrode voltage Vcom as represented by the upward arrow) corresponding to the image data "0" used for display. This voltage is maintained until the gate electrode is turned off.

During the first half of the output period T4, the pixel electrode is charged with the gray scale voltage V0 having a negative potential of −v0 (which is higher than the common electrode voltage Vcom). During the second half of the output period T4, the pixel electrode is charged with the gray scale voltage V4 having a desired negative potential −v4 (lower than the common electrode voltage Vcom) corresponding to the image data "4" used for display. This voltage is kept until the gate electrode is turned off. In the next frame, the polarities of the gray scale voltages and the common electrode voltage are opposite to those in this frame. (In the fourth example, the second half of the output period T3 and the first half of the output period T4 are positive driving periods, and the first half of the output period T3 and the second half of the output period T4 are negative driving periods.)

In this example, the inverting timing of the gray scale voltages is advanced with respect to the timing of the output pulses LS by 180 degrees, and the inverting timing of the common electrode voltage Vcom is in phase with the timing of the output pulses LS. Accordingly, the average potential of the data line is maintained at the center value of the gray scale voltage or in the vicinity thereof regardless of the potentials of the gray scale voltage, namely, regardless of the image pattern to be displayed. As a result, the image quality is maintained regardless of the image pattern to be displayed.

The advance of the gray scale voltages V0 through V7 can be larger or smaller than 180 degrees in accordance with the required image quality and the characteristics of the liquid crystal panel.

In the fourth example, in the first half of the output period T3, the potential of the driving voltage is negative (i.e., lower) with respect to the common electrode voltage Vcom as described above, but the polarity of the desired gray scale voltage corresponding to the image data used for display is positive with respect to the common electrode voltage Vcom. In the next output period T4, the potential of the driving voltage is positive (i.e., higher) with respect to the common electrode voltage Vcom as described above, but the polarity of the desired gray scale voltage is negative with respect to the common electrode voltage Vcom. Since the polarity in the first half of each output period is opposite to the polarity of the desired voltage with respect to the common electrode voltage Vcom, the driving waveforms in the second example may be preferable for certain types of display mediums.

In the first through fourth examples, the data driver 102 includes 3-bit unit drivers, but other types of unit drivers can be used.

For example, a data driver including 6-bit or higher-bit unit drivers can be used. In such a case, it is substantially impossible to input the number of gray scale voltages equal to the number of gray scales to the data driver from an external voltage generator. Accordingly, a lesser number of gray scale voltages are input to the data driver as reference voltages and are interpolated to generate the desired number of gray scale voltages equal to the number of gray scales. The principle of the present invention can be used for inputting the reference voltages.

The idea of maintaining the average value of the outputs from the data driver is not limited to any structure of the driver. The present invention can be applied to a driving circuit using an analog driver.

The above-described delay and advance (a certain range around 180 degrees) can be different for a different purpose. For example, Japanese Patent Publication No. 2-7444 is directed to compensating for deterioration in the display quality caused by delay in the output from the driver which accompanies the time constant of the gate lines of the display medium.

In the first through fourth examples, the common electrode voltage Vcom is AC-driven. The present invention is applicable to the case in which the common electrode voltage Vcom is DC-driven.

Figure 15:
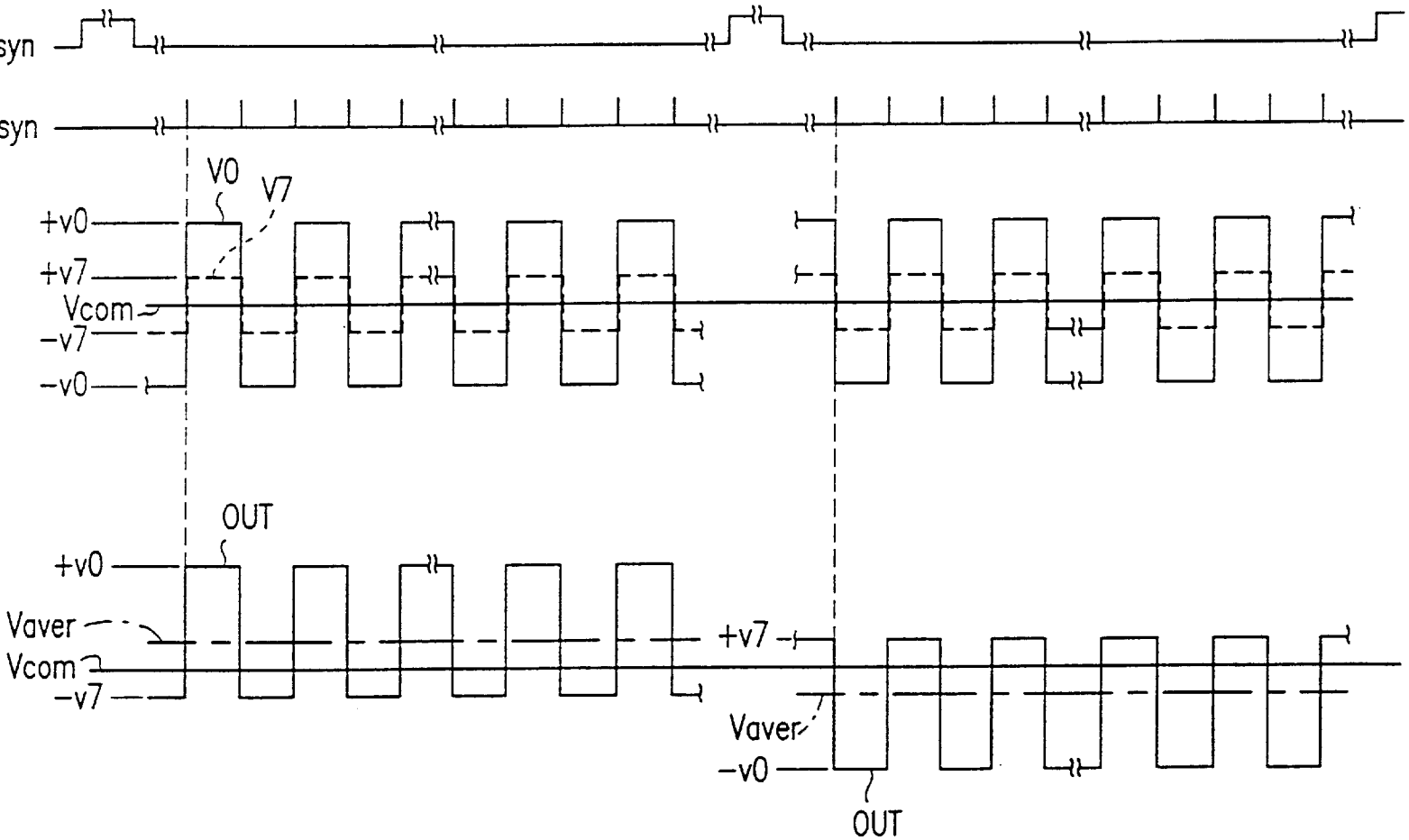
FIG. 15 PRIOR ART
FIG. 15 is a timing diagram illustrating signals for driving a liquid crystal panel by a conventional method while DC-driving a common electrode voltage.

FIG. 15 is a timing diagram for driving a liquid crystal panel by a conventional method. The common electrode voltage Vcom is DC-driven, and the gray scale voltages corresponding to image data "0" and "7" are alternately output. The data driver includes 3-bit unit drivers. Chain line Vaver represents the average potential of the data line to which these signals are input. As shown in FIG. 15, the average value Vaver changes frame by frame, namely, vertical period by vertical period. Thus, the image quality is deteriorated.

Figure 16:
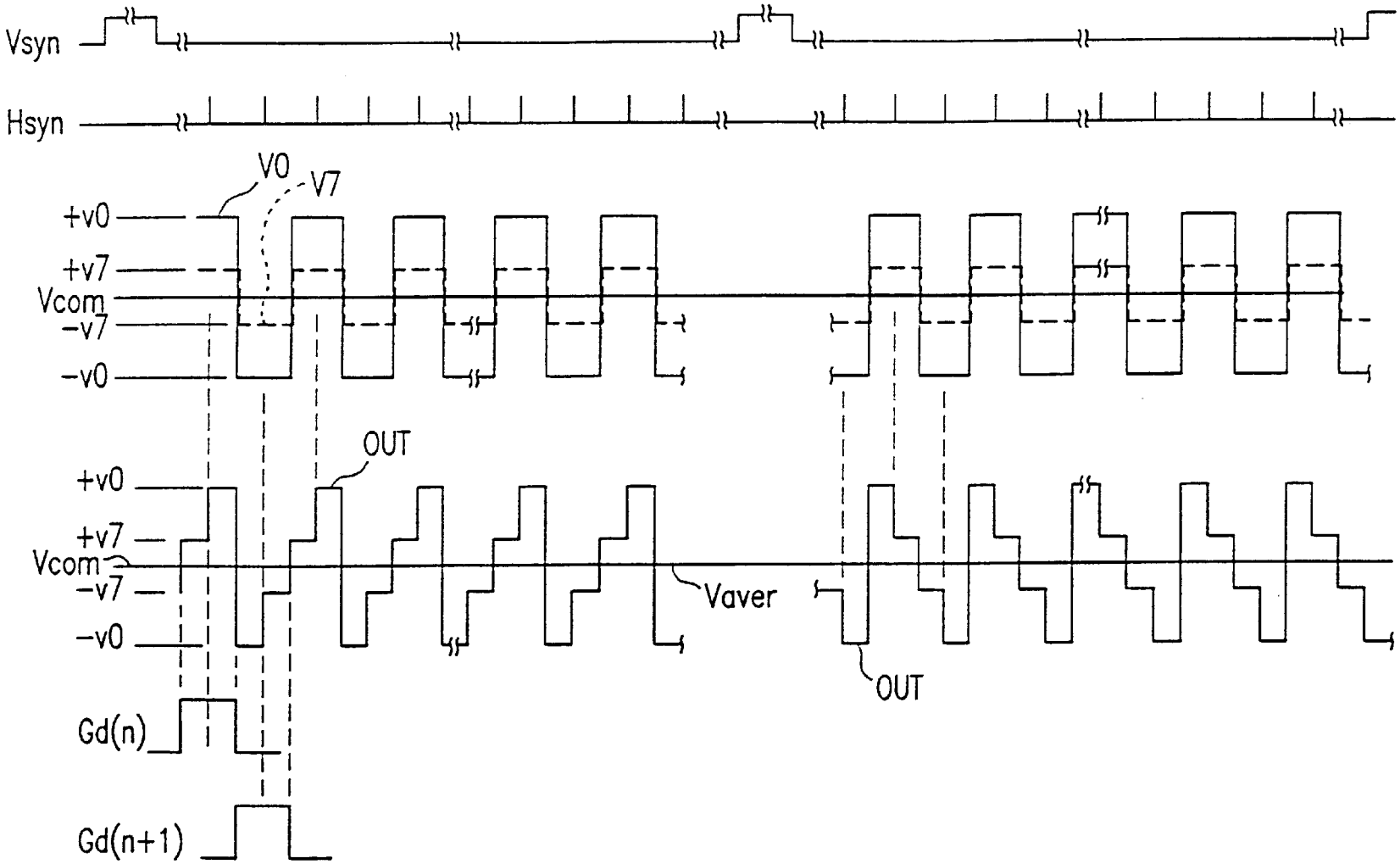
FIG. 16 is a timing diagram illustrating signals for driving a liquid crystal panel by a method according to the present invention while DC-driving a common electrode voltage.

FIG. 16 is a timing diagram for driving a liquid crystal panel by a method according to the present invention. The common electrode voltage Vcom is DC-driven, and the gray scale voltages corresponding to image data "0" and "7" are alternately output. The inverting timing of the gray scale voltages V0 and V7 is advanced with respect to the timing of the output pulses, namely, the Hsyn signal by 180 degrees. The timing of the outputs Gd(n) and Gd(n+1) from the gate driver is advanced with respect to the timing of the Hsyn signal by 180 degrees.

As shown in FIG. 16, the average value Vaver of the data line is equal in continuous frames. Thus, the image quality is maintained without being deteriorated. In FIG. 16, the average value Vaver is equal to the common electrode voltage Vcom. In actual circuits, the common electrode voltage Vcom is adjusted to compensate for the characteristic difference of the liquid crystal panel with respect to the positive and negative gray scale voltages, and thus the common electrode voltage Vcom can be different from the average value Vaver.

In the first through fourth examples, it is described that the influences exerted on the pixel by the potential of the data line is caused by the source-drain capacitance Csd or the off-state resistance of the switching device. The present invention is also applicable to avoid the influences caused by all the capacitances in the equivalent circuit shown in FIG. 5B. These capacitances include, for example, a capacitance between the pixel electrode and the data line, a capacitance between the storage capacitor and the data line, and a capacitance between the storage capacitor and the source electrode (the electrode of the TFT used as the switching device connected to the data line).

As has been described so far, a method and a circuit for driving a liquid crystal panel maintains the average potential of each of the data lines in the LCD and thus avoid adverse influences on the image quality.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A method for driving a liquid crystal panel including:

a plurality of pixel electrodes arranged in a matrix, a plurality of data lines respectively connected to the pixel electrodes in a plurality of columns, a plurality of gate lines respectively connected to the pixel electrodes in a plurality of rows, and a plurality of switching devices, respectively connected to the pixel electrodes, for connecting and disconnecting the corresponding pixel electrodes and the corresponding data lines based on a signal sent from the corresponding gate lines, the method comprising the steps of:

during a same time period, applying a gray scale voltage having a waveform corresponding to an image data used for display to each data line while inverting the gray scale voltage gate line-by-gate line and a frame-by-frame, wherein an average value of the gray scale voltage during each output period is maintained within a certain range.

2. A method according to claim 1, wherein a first pixel electrode and a second pixel electrode among the plurality of pixel electrodes are connected to an identical data line, and the certain range is set so that a difference of the potential of the first pixel electrode from a prescribed potential caused by a change in the average potential of the data line in a first frame in which the first pixel electrode is charged and a difference of the potential of the second pixel electrode from the prescribed potential caused by the change in the average potential of the data line in a second frame following the first frame in which the second pixel electrode is charged has a relationship which causes no substantial influence on the luminance on the liquid crystal panel.

3. A method for driving a liquid crystal panel including:

a plurality of pixel electrodes arranged in a matrix, a common electrode opposed to the plurality of pixel electrodes with a liquid crystal layer interposed therebetween, a plurality of data lines respectively connected to the pixel electrodes in a plurality of columns, a plurality of gate lines respectively connected to the pixel electrodes in a plurality of rows, and a plurality of switching devices, respectively connected to the pixel electrodes, for connecting and disconnecting the corresponding pixel electrodes and the corresponding data lines based on a signal sent from the corresponding gate lines, the method comprising the step of:

applying a gray scale voltage having a waveform corresponding to image data used for display to each data line and applying a common electrode voltage to the common electrode while inverting the polarity of the gray scale voltage and the polarity of the common electrode voltage gate line by gate line and frame by frame, wherein both a positive gray scale voltage and a negative gray scale voltage are output in each of a plurality of output periods, and an average value of the driving voltage during each output period is maintained within a certain range.

4. A method according to claim 3, wherein each of the plurality of output periods includes one of a positive driving period in which a polarity of the gray scale voltage with respect to the common electrode voltage is positive or a negative driving period in which a polarity of the gray scale voltage with respect to the common electrode voltage is negative.

5. A method according to claim 3, wherein the plurality of output periods includes both a positive driving period in which a polarity of the gray scale voltage with respect to the common electrode voltage is positive and a negative driving period in which a polarity of the gray scale voltage with respect to the common electrode voltage is negative.

6. A method according to claim 3, wherein a time period in which the positive gray scale voltage is output and a time period in which the negative gray scale voltage is output are substantially equal, and the polarity of the gray scale voltage is inverted once in each output period.

7. A method according to claim 4, wherein, where the positive driving period and the negative driving period are each divided into a first half and a second half, the gray scale voltage is positive in the first half of the positive driving period and is negative in the first half of the negative driving period, and a voltage to be applied to each of the gate electrodes changes from a high level to a low level in phase with the polarity inverting timing of the gray scale voltage in each driving period so as to turn off the corresponding switching device.

8. A method according to claim 4, wherein, where the positive driving period and the negative driving period are each divided into a first half and a second half, the gray scale voltage is positive in the second half of the positive driving period and is negative in the second half of the negative driving period, and a voltage to be applied to each of the gate electrodes changes from a high level to a low level in phase with the end of each output period so as to turn off the corresponding switching device.

9. A circuit for driving a liquid crystal panel while inverting a driving voltage gate line by gate line and frame by frame, including:

a plurality of pixel electrodes arranged in a matrix;

a plurality of data lines respectively connected to the pixel electrodes in a plurality of columns;

a plurality of gate lines respectively connected to the pixel electrodes in a plurality of rows; and a plurality of switching devices, respectively connected to the pixel electrodes, for connecting and disconnecting the corresponding pixel electrodes and the corresponding data lines based on a signal sent from the corresponding gate lines;

the circuit comprising:

a plurality of digital data driving circuits, respectively provided for the plurality of data lines, for receiving a plurality of gray scale voltages having a rectangular wave and inverting output period-by-output period and outputting at least one gray scale voltage corresponding to the image data used for display to the corresponding data line as the driving voltage, wherein the digital data driving circuits each output both a positive bray scale voltage and a negative gray scale voltage during each output period so as to generate a phase difference between the polarity inverting timing thereof and the timing of output pulses which define the output periods, and the phase difference is set so as to maintain an average value of the driving voltage during each output period within a certain range regardless of the potentials of the gray scale voltages corresponding to the image data used for display.

10. A circuit according to claim 9, wherein a first pixel electrode and a second pixel electrode among the plurality of pixel electrodes are connected to an identical data line, and the certain range is set so that a difference of the potential of the first pixel electrode from a prescribed potential caused by a change in the average potential of the data line in a first frame in which the first pixel electrode is charged and a difference of the potential of the second pixel electrode from the prescribed potential caused by the change in the average potential of the data line in a second frame following the first frame in which the second pixel electrode is charged has a relationship which causes no substantial influence on the luminance on the liquid crystal panel.

11. A circuit according to claim 9, wherein the phase difference between the polarity inverting timing of the driving voltage and the timing of the output pulses is a prescribed range around 180 degrees.

12. A circuit according to claim 9, wherein the polarity inverting timing of the driving voltage is delayed with respect to the timing of the output pulses.

13. A circuit according to claim 9, wherein the polarity inverting timing of the driving voltage is advanced with respect to the timing of the output pulses.

14. A circuit according to claim 12, further comprising a gate driver for sending pulses to the plurality of gate lines for turning on and off the plurality of switching devices, the gate driver sending the pulses fall in phase with the end of each output period.

15. A circuit according to claim 13, further comprising a gate driver for sending pulses to the plurality of gate lines for turning on and off the plurality of switching devices, the gate driver sending the pulses so that the pulses fall in phase with the polarity inverting timing of the driving voltage.

16. A circuit according to claim 9, further comprising:

a common electrode opposed to the plurality of pixel electrodes with a liquid crystal layer interposed therebetween; and a common electrode driver for applying a common electrode voltage having a rectangular wave and inverting output period by output period to the common electrode, wherein the digital data driving circuit has a configuration for delaying the gray scale voltage corresponding to the image data used for display with respect to the output pulses by the phase difference, and the common electrode driver applies the common electrode voltage so that the polarity inverting timing of the common electrode voltage is substantially in phase with the timing of the output pulses which define the output periods.

17. A circuit according to claim 9, further comprising:

a common electrode opposed to the plurality of pixel electrodes with a liquid crystal layer interposed therebetween; and a common electrode driver for applying a common electrode voltage having a rectangular wave and inverting output period by output period to the common electrode, wherein the digital data driving circuit has a configuration for delaying the gray scale voltage corresponding to the image data used for display with respect to the output pulses by the phase difference, and the common electrode driver applies the common electrode voltage so that the polarity inverting timing of the common electrode voltage is delayed with respect to the timing of the output pulses which define the output periods by substantially the same degree as the gray scale voltage.

18. A circuit according to claim 9, further comprising:

a common electrode opposed to the plurality of pixel electrodes with a liquid crystal layer interposed therebetween; and a common electrode driver for applying a common electrode voltage having a rectangular wave and inverting output period by output period to the common electrode, wherein the digital data driving circuit has a configuration for advancing the polarity inverting timing of the gray scale voltage corresponding to the image data used for display with respect to the output pulses by the phase difference, and the common electrode driver applies the common electrode voltage so that the polarity inverting timing of the common electrode voltage is advanced with respect to the timing of the output pulses which define the output periods by substantially the same degree as the gray scale voltage.

19. A circuit for driving a liquid crystal panel while inverting a driving voltage gate line by gate line and frame by frame, including:

a plurality of pixel electrodes arranged in a matrix;

a plurality of data lines respectively connected to the pixel electrodes in a plurality of columns;

a plurality of gate lines respectively connected to the pixel electrodes in a plurality of rows; and a plurality of switching devices, respectively connected to the pixel electrodes, for connecting and disconnecting the corresponding pixel electrodes and the corresponding data lines based on a signal sent from the corresponding gate lines;

the circuit comprising:

a plurality of digital data driving circuits, respectively provided for the plurality of data lines, for receiving a plurality of gray scale voltages having a rectangular wave and inverting output period by output period and outputting at least one gray scale voltage corresponding to the image data used for display to the corresponding data line as the driving voltage, wherein the digital data driving circuits each output the gray scale voltage so as to generate a phase difference between the polarity inverting timing thereof and the timing of output pulses which define the output periods, and the phase difference is set so as to maintain an average value of the driving voltage during each output period within a certain range regardless of the potentials of the gray scale voltages corresponding to the image data used for display, the circuit further comprising:

a common electrode opposed to the plurality of pixel electrodes with a liquid crystal layer interposed therebetween; and a common electrode driver for applying a common electrode voltage having a rectangular wave and inverting output period by output period to the common electrode, wherein the digital data driving circuit has a configuration for advancing the polarity inverting timing of the gray scale voltage corresponding to the image data used for display with respect to the output pulses by the phase difference, and the common electrode driver applies the common electrode voltage so that the polarity inverting timing of the common electrode is substantially in phase with the timing of the output pulses which define the output periods.

* * * * *